US006251048B1

(12) United States Patent
Kaufman

(10) Patent No.: US 6,251,048 B1
(45) Date of Patent: Jun. 26, 2001

(54) ELECTRONIC EXERCISE MONITOR

(75) Inventor: Arthur H. Kaufman, Boca Raton, FL (US)

(73) Assignee: EPM Develoment Systems Corporation

( * ) Notice: Subject to any disclaimer, the term of this patent is extended or adjusted under 35 U.S.C. 154(b) by 0 days.

(21) Appl. No.: 09/228,590

(22) Filed: Jan. 12, 1999

Related U.S. Application Data

(63) Continuation-in-part of application No. 08/869,749, filed on Jun. 5, 1997, now Pat. No. 5,857,939.

(51) Int. Cl.[7] ..... A63B 69/00

(52) U.S. Cl. ..... 482/8; 482/1; 482/9; 482/902; 73/379.01; 601/23

(58) Field of Search ..... 482/1–9, 900–902; 601/23, 33–36; 73/379.01–379.09

(56) References Cited

U.S. PATENT DOCUMENTS 4,824,103 * 4/1989 Smidt ..... 482/902

5,538,486 * 7/1996 France et al. ..... 482/1

* cited by examiner

*Primary Examiner*—Glenn E. Richman
(74) *Attorney, Agent, or Firm*—Adams & Wilks

(57) ABSTRACT

An electronic activity monitor for monitoring the performance of an activity such as an exercise comprises an activity detector responsive to motion associated with the performance of the activity to output a corresponding signal, a processor for receiving the signal and determining a starting address at which a block of corresponding sound data is stored, a memory for storing sound data corresponding to a plurality of values associated with the monitored activity, the sound data preferably comprising data representing a voice representation of the values, and a speech generator for generating a naturally-sounding human voice or reproducing a pre-stored version of an actual human voice or other audible indicia in accordance with the sound data stored in the memory. The speech generator is controlled by the processor in response to the activity detector to provide a verbal representation of the user's performance of the activity. Motivational speech may also be generated to encourage correct and continued performance of the activity.

8 Claims, 12 Drawing Sheets

ELECTRONIC EXERCISE MONITOR

The present application is based on prior U.S. application Ser. No. 08/869,749, filed on Jun. 5, 1997, now U.S. Pat. No. 5,857,939, which is hereby incorporated by reference, and priority thereto for common subject matter is hereby claimed.

FIELD OF THE INVENTION

The present invention relates generally to an exercise monitoring device and, more particularly, to an audible exercise monitoring device designed for stand-alone use, to be worn on a part of a user's body, for incorporation into an exercise mat or other surface, or as part of a piece of exercise equipment, such as one of the type having a displaceable member adapted to undergo reciprocal (i.e., cyclical) movement in response to a repetitive curling, bending, pushing, pulling, or pressing force of a user. More specifically, the present invention relates to an audible electronic exercise monitoring, coaching and training device which monitors the user's exercise performance and issues audible and optionally visual and textual indicia, such as a verbal count of the rate, distance, number of exercise repetitions, and the like, performed by the user and/or issues audible alarms, verbal instructions, verbal motivation and encouragement and other verbal or textual information and instruction.

DESCRIPTION OF RELATED ART

A wide variety of different types of equipment is available for exercising different individual muscles and muscle groups of the human body. Free weights, such as dumbbells and barbells, have long been widely used in both commercial and residential settings. Low cost universal-type weight training equipment has more recently become accessible to consumers for residential use, as have sophisticated cardiovascular exercise devices such as electromechanical stationary bicycles, motorized treadmills, hydraulic stair climbers, rowing machines, aerobic riders, aerobic flyers, and the like.

Many different types of cardiovascular exercise equipment are provided with electronic monitoring devices for tracking the user's performance and providing the user with a practical performance target or goal. Even inexpensive stationary bicycles, stair climbers and treadmills are often provided with built-in timers, pulsemeters, calorie counters, speedometers, odometers and/or pedometers. Such devices are relatively inexpensive to produce and are simple in design, relying upon the use of a single programmed microprocessor or application-specific integrated circuit to calculate various information using performance data acquired from standard sensors. For instance, the number of calories expended during an exercise may be determined using a simple calculation based upon the exercise resistance, exercise rate and elapsed time. Pulse rate monitoring devices are also of simple design and low cost. By monitoring the user's pulse, the number of calories expended and the like, the user may be provided with a practical indication of his or her exercise progress and performance.

The use of electronic monitoring instruments in conventional cardiovascular training equipment has had some beneficial fitness results, including a moderate increase in the level of user interest and an increased level of exercise performance. However, the most beneficial results of any exercise are obtained when an individual is given a specific, easily understandable performance target, is informed of his or her exercise progress, and is given verbal motivation, coaching, encouragement and instruction. When this is done, the individual is generally more interested in performing an exercise routine correctly and completely, and the results of the exercise routine are markedly improved.

While pulsemeters, calorie counters, odometers, pedometers, and the like, serve to increase user interest, they do not serve to directly motivate or coach the individual to complete an exercise program. Nor do such devices ensure that an individual is performing an exercise routine correctly or completely, or that the user is following an appropriate dietary regimen. Moreover, electronic monitoring devices of the type described above are of limited utility in connection with non-cardiovascular, strength training exercise equipment such as free weights and isometric exercisers. While such devices are useful for monitoring cardiovascular exercises, information such as pulse rate, elapsed time and calories expended is only of secondary importance in non-cardiovascular exercises, which are generally designed to increase muscle strength. While the primary goal of cardiovascular exercise is to maintain a target elevated pulse rate for a prolonged period of time, the goal of most non-cardiovascular exercises is the targeting of individual muscles for a relatively short period of time to increase strength. Such exercises do not generally result in prolonged heart rate elevation. Thus, even highly sophisticated non-cardiovascular training equipment is not generally provided with electronic monitoring equipment similar to that described above. Users of such equipment are therefore required to perform non-cardiovascular exercises in the presence of fitness professionals or are otherwise relegated to perform boring, strenuous exercise routines alone and to monitor their own performance. Additionally, exercise routines are often accompanied by dietary regimens requiring the intake of certain foods and food supplements at specific times and in specific quantities. Nor do conventional exercise monitoring devices provide the user with any dietary information to assist the user in maintaining a specific exercise and dietary program.

Although they are perhaps the most important part of any weight training exercise routine, the last one or two repetitions are also the most difficult to perform. At the point an individual reaches the last few repetitions of an exercise, the individual is under a great deal of physical stress. Despite the importance of the last few repetitions of such an exercise, these last repetitions are extremely difficult. In the absence of a spotter or personal trainer for providing verbal motivation and encouragement, many individuals have found it difficult to properly complete these last few repetitions of a weight training exercise due to the lack of self-motivation brought on by intense physical stress. Although prior art monitoring devices exist for monitoring the results of an exercise, no previously-available electronic exercise monitoring device has addressed the need for providing an individual with the motivation and encouragement needed to complete an exercise routine.

Another good example of this is situps and pushups. While pushups are a highly beneficial exercise, there are no electronic monitoring or coaching devices available for use in conjunction with pushups. Similarly, situps are generally the most straightforward and useful exercise motion for addressing the entire abdominal structure of the human body. However, they are also strenuous to perform, boring and very difficult to monitor. There are no electronic monitoring devices available for stand-alone use in conjunction with situp or pushup type exercises, and the individual performing such exercises must either rely upon another person to monitor their performance or must somehow keep track of his or her own performance.

Even though several types of exercise devices have been developed for use in exercising the abdominal muscles by augmenting the natural resistive force of gravity against the human body, such devices are not generally provided with any type of electronic monitoring equipment similar to that provided in cardiovascular fitness equipment.

Although there are a virtually unlimited number of different types of mechanical devices designed to replace exercises such as pushups and situps, most of these devices, despite their high cost, provide little or no added benefit over fundamental exercises such as situps and pushups. Nor do any of these devices provide a means for monitoring, motivating, or coaching the user to correctly and completely perform an exercise.

For instance, various types of rotary movement abdominal exercise devices are available that target the abdominal muscles. Some such devices are designed to facilitate curling motion while a person is originally lying in a supine position. Other such devices are designed to facilitate such motion while a person is in a seated position. Such equipment, however, is entirely mechanical in nature and is not generally provided with electronic monitoring devices. In one known abdominal exercise device, for example, the user performs abdominal curling exercises against a resistance provided by the machine. The user is seated in an upright position and performs the curling and uncurling motion against a resistance provided by a bar mounted in a cantilevered manner on an arm which pivots about a fixed point forwardly and rearwardly with the user's curling and uncurling exercise motion. In another well known variation of this device, the bar is adapted to undergo variable resistance throughout the curling and uncurling motion to maximize exercise benefits. There are no electronic monitoring devices provided in this type of equipment for monitoring a user's performance and offering verbal motivation and encouragement. As a result, the individual is required to monitor his or her own performance or to rely upon another person, such as a personal trainer.

Another abdominal exerciser which has recently become popular is designed to support the user's head and neck while performing situp type exercises from a supine position. The device is formed of a tubular frame defining a pair of laterally spaced support rails, a pair of laterally spaced rocker portions, a pair of laterally spaced arm rest portions and a connecting portion for connecting the support rails together. Cushions are disposed on the arm rest portions to receive the elbows of the user when in a lying position. The head and neck of the user are supported on a padded support extending across the connecting portion. In one variation of this device, the rocker portions are curved on a circular arc to match the curvature of the spine when performing the situp type exercises. In another variation of this device, the rocker portions are merely pivot points designed to facilitate rocking motion on a circular arc, also to match the curvature of the spine when performing the situp type exercises. While this basic device is available in various other configurations, with or without arcuate portions, each such variation is designed to support the user's neck and head when performing situps or crunches. For example, in another variation, the connecting portion is disposed proximate the arm rest portions of the device, rather than the head rest portion.

Much like weight training equipment and other types of non-cardiovascular fitness equipment, none of the foregoing types of exercise equipment is provided with an electronic device for providing useful instructions to the user, monitoring the user's performance level, increasing the user's interest level by providing verbal motivation and encouragement, informing the user of an attainable goal, or providing the user with a suitable exercise and dietary regimen. Additionally, there are very few available monitoring devices for use with exercises that are performed without the use of any type of exercise device. As noted above, conventional exercise monitoring devices also do not provide the verbal motivation and encouragement of a personal trainer. Situps, for example, may be performed on an exercise mat or floor without the use of a curling device. Pushups may also be performed on any flat surface. When an exercise is performed without the use of any type of exercise equipment, no electronic monitoring device is generally used. A need therefore exists for an electronic exercise monitor for stand-alone use, to be worn on a part of the user's body, or for at least partial incorporation into a piece of exercise equipment or an exercise surface to monitor an exercise and provide the user with verbal motivation, and optionally to provide the user with useful instructions and information concerning his or her exercise performance, to warn the user of an incorrect or potentially dangerous condition, to provide the user with verbal encouragement and motivation to perform an exercise correctly and completely, and to assist the user in maintaining a desirable diet and exercise routine.

Although there have been previous attempts to provide such instructional information and encouragement through the use of pre-recorded audio and video exercise programs, no such program is capable of monitoring the performance of the user while performing the exercise described and shown on the pre-recorded program.

SUMMARY OF THE INVENTION

In view of the foregoing, an object of the present invention is to provide a device for use in monitoring the progress and performance of an activity (such as an exercise routine) and for providing a verbal indication of the user's performance.

Another object of the present invention is to provide a device for use in monitoring a user's progress and performance of an exercise routine and for ensuring that the exercise routine is correctly performed.

Another object of the present invention is to provide a device for use in monitoring the progress and performance of an exercise routine, for ensuring that the exercise routine is correctly performed, and for issuing a verbal indication of the monitored exercise progress and performance and verbal encouragement and alarms.

Another object of the present invention is to provide a device for monitoring at least one function associated with the performance of an exercise and issuing a verbal representation thereof at selected times.

Still another object of the present invention to provide exercise monitoring devices of the aforementioned types for stand-alone use with or without exercise equipment, or for incorporation into a piece of exercise equipment or an exercise surface for monitoring exercises performed by a user.

Yet another object of the present invention is to provide exercise monitoring devices of the aforementioned types designed for stand-alone use with or without exercise equipment, or to coact with or for incorporation into various different types of exercise equipment for monitoring an exercise performed by a user while using the exercise equipment, or to provide a verbal indication of one or more monitored exercise functions such as exercise rate, distance, time, pulse rate, calories expended, breathing pattern, heart or muscle strength, and the like.

Still yet another object of the present invention is to provide a device capable of monitoring the number of exercise repetitions performed while using a known exercise device.

Another object of the present invention is to provide an exercise monitor capable of detecting when exercises are being performed improperly by the user and issuing an audible alarm.

Another object of the present invention is to provide an exercise monitor for monitoring, coaching and training a user, and issuing audible indicia such as a verbal representation of at least one monitored function, audible alarms, instructions, motivation and encouragement, and/or information relating to exercise and diet programs.

An additional object of the present invention is to provide an electronic exercise monitor which verbally informs the user of his or her exercise progress and/or which offers the user verbal encouragement and motivation.

These and other objects are achieved by the present invention, which provides an electronic exercise monitoring device for monitoring the performance of an exercise by a user. In accordance with a first aspect of the present invention, the exercise monitoring device comprises one or more exercise detection means each for detecting a function associated with the performance of an exercise and outputting a corresponding signal which varies in accordance with the detected function, processing means for receiving the signal output from each of the one or more exercise detection means and determining therefor a starting address at which a block of corresponding sound data is stored, a memory for storing sound data associated with the at least one detected exercise function, and a speech generator for generating a voice in accordance with the sound data, the speech generator being controlled by the processing means in response to the one or more exercise detection means to output a verbal representation associated with the one or more detected exercise functions and/or a variable determined in accordance therewith at selected times as a user progressively performs the exercise.

As will be appreciated by those of ordinary skill in the art, the sound data may comprise data for producing a verbal representation of the monitored exercise function, a variable determined by the processing means in accordance therewith, or a motivational phrase selected based upon the monitored exercise function and indicating a relative exercise performance level.

In accordance with a second aspect of the present invention, the exercise monitoring device comprises one or more exercise detection means each for detecting a function associated with the performance of an exercise and outputting a corresponding signal which varies in accordance with the detected exercise function, processing means for receiving the signal output from each of the one or more exercise detection means and determining therefor a starting address at which a block of corresponding sound data is stored, a memory for storing first sound data associated with the at least one detected exercise function and second sound data representative of a plurality of verbal phrases for encouraging the user to continue to perform the exercise or alarming the user of an incorrect or potentially dangerous condition, and a speech generator for generating a voice in accordance with first and second sound data stored in the memory, the speech generator being controlled by the processing means in response to each exercise detector to output a verbal representation of the one or more detected exercise functions at selected times as a user progressively performs the exercise in accordance with the first sound data, and to output a selected verbal phrase selected from the second sound data based on the value of a detected exercise function so as to inform the user of his or her exercise progress, to motivate the user to continue to perform the exercise correctly, or to provide a verbal alarm to the user.

The detected exercise functions may comprise any functions associated with the performance of an exercise, which may depend upon the particular exercise that is being performed. Such functions include, but are not limited to, time, distance, number of laps, number of repetitions, speed, pulse rate, height, calories expended, applied force, breathing pattern, accuracy, and the like. Any other function associated with the performance of an exercise or other activity may also serve as a detected function in accordance with the present invention, the particular type of function not being limited to those described herein.

In accordance with another aspect of the present invention, the electronic exercise monitor is adapted for stand-alone use to permit use of the device in conjunction with exercises that are performed with or without the use of a piece of exercise equipment, such as walking, jogging, running, situps, pullups, weight training, bicycling, swimming, and the like. The exercise monitor utilizes an exercise motion detector of conventional structure for detecting an exercise function associated with a particular exercise, such as distance traveled (in the case of walking, jogging, running, cycling or treadmill exercises), or, for instance, for detecting a specific motion (in the case of situps, pushups, swimming, and the like), for detecting the repetitive motion associated with the performance of the exercise and for outputting a corresponding signal which varies in accordance with the performance of the exercise. Alternatively, or in addition thereto, the exercise monitor may be provided with a detector for measuring a physiological condition of the user as a function associated with the performance of an exercise, such as a pulse meter for monitoring the user's pulse or a stress gauge for monitoring movements of the user's chest in accordance with the user's breathing pattern. In accordance with this aspect of the present invention, the exercise monitor may be fully or partially housed in a case or package that may be carried or worn by the user on the wrist, ankle, waist, glove, neck, hat, and the like. Alternatively, the exercise monitor may be built into a piece of exercise equipment or an exercise surface such as an exercise mat. The exercise detection means comprise conventionally available detectors having a structure depending upon the particular exercise function being monitored. Examples are noted above. In the case of exercise repetitions, the detector may simply comprise a switch or other input means capable of detecting successive repetitions of a repetitive exercise, such as presses, extensions, pushups or situps, that are being performed by the user.

In accordance with another aspect of the present invention, the exercise monitor is incorporated at least partially into a piece of exercise equipment and the exercise motion detector comprises means for detecting movement of a displaceable member of the exercise equipment, such as a cantilevered arm, a flywheel, a cable, a barbell, or the like, the detecting means being responsive to the repeated motion of the displaceable member, for example, to output a signal which varies in accordance with the cyclical movement (such as rotary, linear, reciprocal, and the like) of the displaceable member in response to performance of an exercise by the user on the exercise equipment. Any means capable of detecting the cyclical performance of an exercise on a piece of exercise equipment may be used as the motion detector. As noted above, the exercise monitor may also be provided with an exercise detector comprising means for monitoring a physiological condition of the user, such as the user's pulse rate, oxygen intake, EEG, and the like, so as to monitor the user's physiological condition as a function of the exercise being performed. In all cases, the physiological condition may be the sole monitored function, or one of a plurality of monitored functions.

In each of the above-described aspects of the present invention, the processing means receives an output signal of the exercise detector, which varies in accordance with the monitored exercise function, and determines therefor at selected times a starting address at which a block of corresponding sound data is stored. The memory stores sound data representative of a voice for all or some values of the monitored function(s) so as to provide a verbal representation of a monitored function and/or sound data representative of motivational phrases. In order to generate a voice representation of the one or more monitored functions or a selected motivational phrase, the exercise monitor is further provided with a speech generator for generating a naturally-sounding human voice (or reproducing a pre-stored version of an actual human voice) or other audible indicia in accordance with the sound data stored in the memory. The speech generator is controlled by the processing means in response to the exercise monitor so as to provide, at selected times, a verbal indication of the performance of the exercise by the user and/or verbal motivation. Thus, for example, if the monitored function comprises exercise repetitions, the exercise monitor may progressively count some or all of the sequential exercise repetitions performed by the user and may encourage the user to complete the exercise routine.

In accordance with one embodiment of the present invention adapted to count successive repetitions of an exercise performed on a piece of exercise equipment, a switch (such as a contact switch or a mercury switch) is provided for monitoring the reciprocal movement of a displaceable member of a piece of exercise equipment. Preferably, the switch has contacts disposed such that each full cycle of motion of the displaceable member causes a single, temporary closure of the switch contacts so as to permit the generation of a single pulse for each repetition and to permit detection of successive exercise repetitions which are to be verbally counted by the exercise monitor. A voice count is generated for all or only for selected ones of the exercise repetitions. In another embodiment, rotary motion of a displaceable member of a bicycle or treadmill is monitored and linear distance and/or speed is calculated based on the rotary motion. A corresponding verbal representation of the distance and/or speed is generated at selected times. In accordance with the present invention, the electronic exercise monitor provides a verbal representation of one or more monitored exercise functions rather than merely a visual indication, such that the user need not be mindful of a visual display and may instead concentrate on the exercise. However, a visual display may also be provided to supplement the verbal representation and, optionally, to provide a continuous indication of the one or more monitored functions in cases where a verbal count is not issued continuously.

In the case of repetitive exercises in which sets of successive exercise repetitions are being monitored, the electronic exercise monitor is preferably provided with input means to enable the user to set a desired exercise rate, a desired number of repetitions per set, and a desired enunciation pattern. To accomplish this, a first selector may be provided for selecting an exercise rate at which human voice patterns will be produced, the selected rate being variable between a predetermined minimum value and a predetermined maximum value (i.e., a tempo), a second selector may be provided for selecting a desired number of repetitions per set (hereinafter referred to as a "repetition number"), and a third selector may be provided for selecting an enunciation pattern at which the human voice will be produced, such as by issuing a verbal count every one repetition, or issuing a verbal count every five repetitions, or issuing a verbal count every ten repetitions, etc. When the first through third selectors are included, the processing means is provided with means responsive to the first through third selectors for setting the rate at which the human voice is read out from the memory, for detecting when to reset the count value so as to count successive sets of an exercise, and for controlling the enunciation pattern in the desired manner.

Alternatively, or additionally, the electronic exercise monitor may be provided with a switch for causing the issuance of a verbal representation of a monitored function or other verbal indicia when activated, thereby providing the user with means for generating a voice representation at random, user selectable times.

In addition or instead of providing a verbal representation of one or more monitored functions associated with the performance of an exercise or activity, such as the time, rate, distance, number of laps, number of repetitions, pulse rate, calories expended, applied force, breathing pattern, accuracy, and the like, the exercise monitor may also be programmed to issue verbal phrases and/or to provide other information to the user depending upon the value of a monitored function (or elapsed time), such as verbal encouragement to motivate the user to continue to perform the exercise correctly, instructions to guide the user in a desired manner, alarms to warn the user of an incorrect or potentially dangerous condition, and information concerning a desirable exercise and dietary routine. In order to accomplish this, the processing means may be programmed to control the speech generator to issue, at selected times, a selected phrase stored in the memory. For instance, the device may be programmed to issue instructions at the commencement of an exercise, or to monitor the user's performance of the exercise and inform the user as to the correct manner to perform the exercise. Audible and preferably verbal alarms may be generated when the user is incorrectly performing the exercise such as by performing it too fast or slow, or, for instance, when a detected physiological condition indicates a potentially dangerous condition. Thus, for instance, if the user's pulse rate is too low for too long, the device may advise the user that he or she has not attained a desired target pulse range. If the user's pulse is exceedingly high or has remained at an elevated rate for too long, an audible alarm may be generated to warn the user of a potential danger, or to simply instruct the user to slow down. Verbal encouragement may be issued at selected times during the performance of an exercise, and is most preferably issued based on the value of a particular monitored function. Thus, for example, a selected motivational phrase can be issued when the user is nearing the end of an exercise, or when the user has slowed down, so as to encourage the user to complete the exercise correctly. As will be appreciated, these types of verbal phrases, which are selected by the processing means dependent upon the value of a monitored function, can be the sole verbal output of the electronic exercise monitor. The user can also be instructed as to the appropriate type and duration of warm up and cool down activities.

In the case of a monitored function which results in the issuance of a verbal representation on a relatively frequent basis, such as number of repetitions, verbal encouragement may be generated between or in the place of one or more successive verbal count numbers and/or sets. Thus, for example, where the verbal encouragement comprises only one or two short words, it may be issued between successive repetition counts. On the other hand, when the available time between successive counts is short and where the verbal encouragement comprises a relatively long phrase, it may be generated to replace one or more verbal repetition counts while the processing means keeps track of the proper count. When the exercise rate is relatively slow, or between successive sets, however, even a long phrase may be inserted between successive repetition counts. As will be appreciated by those of ordinary skill in the art, the processing means is programmed to determine the appropriate insertion point for verbal phrases of any given duration.

In one embodiment of the present invention, the switch of the exercise monitor is mounted to a displaceable member of an abdominal exercise device which is constructed of a tubular frame comprising a pair of laterally spaced support rails for resting on a support surface (e.g., a floor), a pair of laterally spaced rocker portions each of which extends forwardly from a respective support rail and a pair of laterally spaced arm rest portions, each of which extends rearwardly from a respective rocker portion to receive an elbow and arm of a person disposed between the support rails in a supine position. The switch is mounted to a portion of the tubular frame which comes into and out of contact with the support surface (the floor) once each exercise repetition. An upstanding arch-shaped portion is connected to and between the support rails to define a space to receive the head of a person disposed between the support rails. A support means is also secured to and across the arch-shaped portion of the skeletal frame for supporting the neck and head of a person disposed between the support rails. During an exercise program, the user repeatedly curls his or her upper body in a forward and rearward rocking motion, which allows the user to strengthen the abdominal muscles.

When in use, the person rests his or her elbows or arms on the arm rest portions while lying down and then repeatedly curls his or her body forwardly and rearwardly while rocking on the rocker portions. The switch of the exercise monitor is mounted to the tubular frame in such a manner that closure of the switch contact members occurs once for each exercise repetition, when the portion of the tubular frame on which the switch is mounted comes into contact with the support surface. When the switch contact members come into contact, a current flows through the switch and is detected by the processing means. When the portion of the tubular frame on which the switch is mounted comes out of contact with the support surface, the switch contact members are opened, and no current flows through the switch. By monitoring the flow of current through the switch, the processing means is capable of monitoring the exercise progress of the user. The user conducts isometric contractions by applying a force through his or her arms to the exercise device which, in turn, causes lifting of the head, neck and upper body of the person when contracting the abdominal muscles. The exercise monitor provides a verbal count of the repeated cyclical forward and rearward curling motions and optionally issues synchronized verbal encouragement to the user in the manner described above and set forth in greater detail hereinafter in connection with the detailed description of the attached drawings.

DETAILED DESCRIPTION OF THE PREFERRED EMBODIMENTS

As described above, by using appropriate detecting means well known to those of ordinary skill in the art, the exercise monitor of the present invention can be configured to monitor one or more functions associated with the performance of an exercise, such as time, rate, distance, repetitions, height, pulse rate, and the like, and provide, at selected times, a verbal representation of a monitored exercise function and/or a variable determined in accordance therewith or a motivational prompt selected based upon a monitored function. Verbal instructions, alarms and other indicia can be generated and textual or visual information relating to exercise performance, exercise instructions and dietary information can also be produced. The device can also provide a combination of one or more of these features so that countless variations are possible, some of which will be described below and all of which are considered to be within the scope of the present invention.

Figure 1:
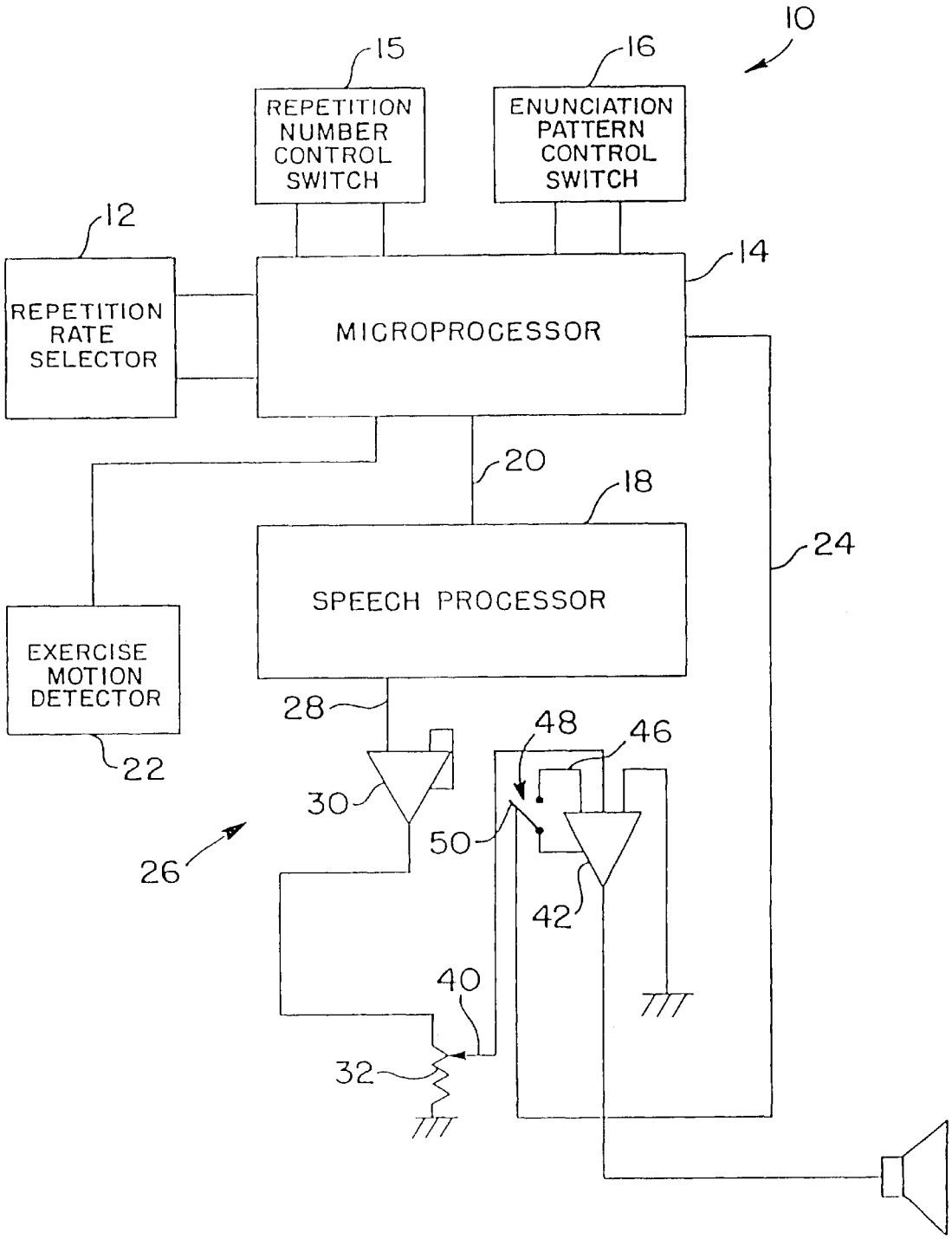
FIG. 1 is a schematic diagram of an electronic exercise monitoring apparatus in accordance with a first embodiment of the present invention.

FIG. 1 is a schematic diagram of an exercise monitoring apparatus 10 in accordance with a first embodiment of the present invention, in which the device is configured for monitoring a repetitive exercise by counting the repetitions thereof in sets and providing a verbal representation thereof along with verbal encouragement. As will be appreciated by those ordinarily skilled in the art, the monitor may easily be configured to provide only one of these verbal outputs. Thus, it is within the scope of the invention to provide a device which produces verbal motivation based upon user performance of an activity. While the first embodiment described below monitors exercise repetitions, any other function associated with the performance of an activity may additionally or alternatively be monitored and verbal representations and motivational phrases can be generated in a manner similar to that described below.

As shown, the system has four main control functions, exercise rate, number of repetitions per set, enunciation pattern, and volume, which produce a synthesized speech pattern that is effective to provide the user with a continuous count of his or her exercise repetitions to assist the user in maintaining a desired exercise rate, and to ensure that the user is correctly performing the exercise. As will be understood, one or all of these control functions may be eliminated, if desired, to simplify the design. One or more of these control functions will also be unnecessary in the case of other monitored functions, most notably those which do not depend upon exercise repetitions (such as jogging).

The selection of the desired exercise rate, in repetitions per minute, is made by setting a repetition rate selector 12. Although the repetition rate of the exercise is a function entirely dependent upon the user's performance of successive exercises, the setting of a target repetition rate by use of repetition rate selector 12 provides various advantages, as will be described below. The repetition rate selector 12 preferably comprises a multi-position switch having poles selectively tied, for example, to +5V so as to provide an input level compatible with that of a processing means, such as a microprocessor 14 or a microcontroller. Alternatively, the repetition rate selector 12 may be in the form of a potentiometer control and designed to produce a pulse train at a frequency corresponding to the desired repetition rate. In the latter case, the repetition rate selector 12 would preferably comprise a monostable multivibrator and a potentiometer control for varying the RC time constant of the monostable multivibrator to produce pulses of a time duration which is a function of the RC time constant at a frequency corresponding to the desired repetition rate.

The range of exercise rates provided by a multi-position switch, or the range of frequency of pulses produced by the repetition rate selector 12 is variable between minimum and maximum rates which are set as realistic rates depending upon the particular exercise. Thus, for example, when the exercise is situps, the device would be set to provide a minimum repetition rate of, for example, 20 repetitions per minute and a maximum repetition rate of 200 repetitions per minute. On the other hand, when the exercise is one such as bench presses, a maximum repetition rate of 100 repetitions per minute and a minimum repetition of 5 repetitions per minute may be more realistic. As wide or narrow a range of repetitions as desired can be provided. The output signal of the repetition rate selector 12 is input to the programmed microprocessor 14. The function of the repetition rate selector 12 in the operation of the microprocessor 14 is described below in conjunction with the flowchart illustrated in FIG. 2.

The desired number of repetitions per set (hereinafter referred to as the "repetition number") and the desired enunciation pattern are selected by setting a repetition number control switch 15 and an enunciation pattern control switch 16, each of which may be a multi-position switch with each pole position corresponding to a desired repetition number and enunciation pattern, respectively. In the preferred embodiment of the invention presently being described, there are four distinct repetition numbers and four distinct enunciation patterns which may be chosen by positioning of repetition number control switch 15 and enunciation pattern control switch 16. As described in greater detail below, the selected repetition rate, repetition number and enunciation pattern are used by the programmed microprocessor 14 to determine the location of a particular address table stored in the microprocessor memory for addressing particular voice data in a speech synthesizer 18. A plurality of separate sets of voice data are stored in the memory of the speech synthesizer 18 and the particular set of voice data chosen for synthesis is determined in accordance with the values of the repetition rate, the repetition number and the enunciation pattern. Thus, the actual human voice pattern which is enunciated for each repetition is set in accordance with the repetition rate, repetition number and enunciation pattern.

The reason a plurality of different sets of voice data address tables are preferably used is to enable the device to generate a naturally-sounding voice which varies depending upon the rate at which the exercise repetitions must be counted. The particular address table selected also depends upon the selected enunciation pattern, as described below, since the particular address locations of the table determine which repetitions will be verbally counted, which repetitions will not be verbally counted, which repetitions will be indicated by non-verbal audible indicia such as by a beep, and which count values or other words will be emphasized. The particular address table that is selected also depends upon the selected repetition number since the particular address locations also determine how high the count will proceed until the address is reset (i.e., when the end of a set is reached).

This is illustrated as follows. If the enunciation pattern control switch 16 is set such that a verbal count is not generated for each successive repetition and is only generated for every other repetition, the enunciation of each verbal count number can be slower than if a verbal count is required for each successive exercise repetition. This is particularly noticeable in the case of a relatively high repetition rate. If a verbal count of each repetition were selected for a high repetition rate, the generated speech would generally need to issued at a fast pitch. If a verbal count were generated for only certain repetitions for an exercise performed at the same rate, the generated speech could be much slower. The use of different address tables for different settings of the repetition rate selector 12, repetition number control switch 15 and enunciation pattern control switch 16 enables the device to produce a naturally sounding voice for all available settings of repetition rate, repetition number and enunciation pattern.

For instance, where only 20 repetitions per minute are to be performed, one verbal count may be generated every three seconds if the enunciation pattern is set so as to count each repetition. Where 100 repetitions per minute are to be performed, a separate verbal count may be required in intervals of less than one second depending, again, upon the selected enunciation pattern. In the latter case, successive verbal counts will be issued on a much faster rate than in the former case. Therefore, the individual verbal counts should be enunciated faster than in the former case. In the former case, or in the case where the enunciation pattern control switch 16 is set to issue a verbal count only for each five or ten repetitions, for example, a greater amount of time is permitted for each verbal count. In such a case, the individual verbal counts can be enunciated slower. Thus, depending upon the selected repetition rate, repetition number and enunciation pattern, different address tables are used to ensure the generation of a naturally-sounding human voice. As will be appreciated by those of ordinary skill in the art, it is not necessary to provide different address tables corresponding to distinct blocks of sound data. Instead, individual voice count numbers can be generated in the same manner regardless of the repetition rate, repetition number and enunciation pattern. The microprocessor can also be programmed to determine an appropriate enunciation pattern depending upon the selected values of the repetition rate and the repetition number. Alternatively, rather than providing means for inputting an exercise rate, the microprocessor 18 can be programmed to monitor the actual exercise rate and determine whether an individual voice count number can be generated depending upon the speed at which the user is performing successive exercise repetitions. As can readily appreciated, there are a countless number of ways the exercise monitor 10 of the present invention can be configured to generate a voice to count successive repetitions of an exercise being performed by a user, and the present invention is not limited to the counting of successive repetitions in any particular manner. As described above, the enunciation of individual count numbers can be constant, or can vary depending on pre-selected values such as repetition rate, repetition number and/or enunciation pattern, or, based on the actual rate at which a user is performing an exercise.

The foregoing considerations are illustrated in the context of repetition counting, but apply equally to the verbal representation of any other monitored function of an activity (such as an exercise), including but not limited to time, distance, speed, number of laps, pulse rate, calories expended, breathing pattern, and the like. In the case of functions other than repetitions, however, it may be preferable for the exercise monitor to issue verbal representations of the monitored function on a less frequent basis. For example, it is not generally desirable to provide a verbal count of every step a user takes while walking, jogging or running. Nor is it generally desirable for the user's pulse to be announced once every heartbeat or every few seconds. For certain monitored functions, it may be preferable to issue a verbal count only at selected intervals, (e.g., each 10 seconds, each 30 seconds, each ¼ mile, etc.). Alternatively or additionally, the exercise monitor can be provided with a switch connected to the microprocessor 18 which is effective to generate a verbal count only when selected by the user. It is also possible to provide a verbal count only when an alarm and/or other verbal information is to be issued, such as when a user's pulse rises too high or the user has completed an exercise routine and the user's performance is given thereafter. The means for providing such functions are readily available in the art.

Accordingly, while the embodiment presently being described includes means for monitoring successive exercise repetitions and utilizes a set of selectors for entering pre-determined values for exercise rate, repetitions per set (repetition number) and enunciation pattern, one or more of these selectors may not be necessary or desired. Where the monitored function is pulse rate, for example, the concept of repetitions per set is not relevant. If a verbal representation is generated only at pre-programmed time intervals, the repetition rate and enunciation pattern would be irrelevant. As noted above, one or more of the selectors can also be eliminated to simplify the design.

As described below, the embodiment presently being described counts the actual exercise repetitions being performed by a user, and does not automatically generate successive counts, such as a metronome (although such can be done in an alternative embodiment). The pre-selected repetition rate set using the repetition rate selector 12 is used by the programmed microprocessor 14 for determining a particular table of addresses so that the enunciation of individual count numbers can be varied depending on the speed at which the exercise is being performed. Thus, while the value specified by the repetition rate selector 12 affects the speed at which individual count numbers are generated, it does not affect the rate at which the exercise monitor 10 generates successive verbal count numbers. However, the pre-set repetition rate value is also useful as an indicator to the device as to when a successive repetition should be expected. Thus, if the user has set the repetition rate selector 12 for 20 repetitions per minute, the microprocessor 14 can be programmed in a known manner to determine whether the user is performing repetitions at this rate. This can be accomplished by causing the microprocessor to poll the input port at which the mechanical switch 22 is connected to monitor the interval between successive repetitions, and to keep a record of successive intervals, if desired. The exercise monitor 10 can generate verbal indica in the manner described below to inform the user that he or she is performing the exercise too fast or too slow depending upon the pre-selected repetition rate value. In that event, the microprocessor 14 can use sound data stored in a memory to generate a verbal phrase to instruct the user to slow down or speed up, for instance, depending upon the monitored results. Sound data can be stored for use in generating one or even a plurality of different phrases to be issued at selected times in a desired manner, such as sequentially, depending upon the user's performance of the exercise.

As used herein, the term "enunciation pattern" refers to the desired voice pattern of the repetition counter. For instance, the user may desire for the device to issue a verbal count for each individual exercise repetition performed by the user. In cases where there are a large number of repetitions per set, for instance, the user may prefer the verbal count to be spaced out such as by being generated only for each two, three, five or ten repetitions. Alternatively, the user may desire a verbal count only upon the completion of each exercise set (the number of repetitions of each set being set using the repetition number control switch 16). In addition, the user may prefer that an audible sound other than a human voice (e.g., a beep) is generated for each one or more exercise repetitions. The combination of a human voice and other audible sound is also possible, such as by generating a human voice for every five or ten repetitions and generating a beep or other non-verbal sounds for each repetition therebetween. In accordance with the present invention, the verbal count numbers can be generated and combined with other audible sounds in countless ways, all of which are well within the capabilities of one of ordinary skill in the art and within the scope of the present invention.

As will also be appreciated by those of ordinary skill in the art, there are a virtually unlimited number of possible enunciation patterns which may be made available. The preferred enunciation patterns discussed above are illustrative only and many different patterns may be used. For example, the enunciation pattern control switch 16 may be provided with settings indicating selectable enunciation patterns of "1", "½", "¼", or "SET". In this case, the setting "1" means that a verbal count is generated for each exercise repetition. The setting "½" means that a verbal count is generated only halfway through each set. Similarly, the setting "¼" means that a verbal count is generated at each of the four quarters of a given exercise set. When the enunciation pattern control switch 16 is placed in the "SET" position, a verbal count is generated only when each successive set of exercise repetitions is completed by the user.

As will be further appreciated by those of ordinary skill in the art, the use of a different address table for each combination of repetition rate, repetition number and enunciation pattern is exemplary only, and a different address table may not actually be needed for each different combination in order to ensure the generation of a naturally-sounding human voice. For example, the address tables can instead be dependent only upon the different combination of repetition number and enunciation pattern. This would be preferable when a potentiometer control and a monostable multivibrator are used as the repetition rate selector. As discussed later, in that case, the time base of the verbal count numbers can be changed depending upon the frequency of pulses output by the multivibrator so that the numbers are actually pronounced faster or slower depending upon the repetition rate set by the user. On the other hand, the microprocessor 14 can be programmed to monitor for the end of a set and the address tables can be selected based solely upon the enunciation pattern set by the user. This method of operation would be utilized, for example, when the exercise monitor does not include a selector for the setting of one or more of the repetition rate, repetition number and enunciation pattern. Even when one or more of the selectors is provided, the address tables, can be eliminated entirely by appropriate programming of the microprocessor 14 to detect, on a step-by-step basis, whether a verbal count number or other audible indicia must be generated for a given repetition, in accordance with a set or pre-programmed enunciation pattern, and by similarly determining whether the end of a set has been reached. The microprocessor program may also include instructions to determine when a verbal count number is to be generated based upon the number of repetitions per set selected by the repetition number control switch 15. These and other similar variations are considered trivial modifications achievable by the user with simple microprocessor programming techniques, and are within the scope of the present invention.

The microprocessor or microcontroller 14 preferably has an internal memory in the form of an electrically eraseable programmable read-only memory ("EEPROM") that is used to store an internal program and program data including the above-described plurality of address tables for identifying the addresses of the sequence of words stored within the dictionary of words of the speech synthesizer 18 which are to be used to synthesize the human voice pattern for each of the possible combinations of repetition rate, repetition number and enunciation pattern selected by the repetition rate selector 12, repetition number control switch 15 and enunciation pattern control switch 16. The internal memory may further comprise a random access memory ("RAM"), if necessary, for the temporary storage of data. As noted above, a record of successive intervals between successive repetitions may be used to determine whether the user is performing the exercise too fast or too slow depending upon the value of the repetition rate set using the repetition rate selector 12. This information could be temporarily stored in RAM. Also, in the case where a verbal representation of a variable such as pulse rate, calories expended, or the like, is determined based upon a calculation, the RAM may be used for temporary storage of data used for performing the calculation. The information content which is stored in the table in the EEPROM is described below.

The speech synthesizer 18 may be a group of integrated circuits which are commercially available and which have either a standard dictionary of words or a special purpose dictionary of words, and may also be a specially ordered or application-specific integrated circuit designed to synthesize speech patterns from a specially programmed dictionary. Alternatively, the speech synthesizer 18 may be a single chip device such as one of the ISD2500 Series single-chip voice record/playback devices produced by Information Storage Devices, Inc. These commercially available single chip voice record/playback devices include an on-board memory for storage of speech samples, and have 60 sec., 75 sec. and 90 sec. durations. The speech samples are stored in the chip using programming equipment made available by the manufacturer. As will be clear to those of ordinary skill in the art, the speech synthesizer 18 utilized in the invention may also be of the type that is provided with an internal microcontroller in a single chip construction, such chips being available from Texas Instruments, for example, and briefly described in connection with the embodiments illustrated in FIGS. 4–9. As will be readily appreciated by those of ordinary skill in the art, the speech synthesizer may comprise any means capable of generating or playing back pre-recorded or pre-stored speech.

In the FIG. 1 embodiment, the programmed microprocessor 14 controls the synthesis of each word from the speech synthesizer 18 by producing an output on an address bus 20 of the starting address of the word in the dictionary of the speech synthesizer 18. As will be appreciated, the particular manner in which the microprocessor controls the speech generator depends upon the manner of operation of the speech generator, since different commercially-available speech generators are controlled in different ways.

An exercise motion detector 22, such as a mechanical switch, provides an output signal which is input to the microprocessor 14. In order for the exercise monitor to perform as a repetition counter, it is necessary for the microprocessor 14 to detect the successive exercise repetitions being performed by the user. In the embodiment presently being described, this is accomplished by the use of the exercise motion detector 22. Upon each successive repetition, the exercise motion detector 22 outputs a signal to the microprocessor 14 to indicate the occurrence of an exercise repetition. The synthesis of each count by the speech synthesizer 18 is initiated only after the microprocessor detects a signal from the exercise motion detector 22. The microprocessor 14 may also be programmed using a known clock routine to monitor the time duration between successively performed repetitions, and, by comparing this duration with the repetition rate selected on repetition rate selector 12, determine whether the user is proceeding too slowly or quickly. In such cases, alarm indicia such as a beep or verbal warning may be issued. For example, if the exercise is being performed too slowly, the device could be programmed to synthesize the words "pick up the pace", "you're slowing down," "you're getting weaker," "faster", and the like. For monitored functions other than the counting of successive repetitions, similar commands can be issued, the particular commands used being applicable to the exercises with which the monitor is used. Thus, for instance, when heart rate is being monitored, the user can be motivated to maintain his or her pulse within a target pulse range for a predetermined period of time. Similarly, a dangerous condition can be avoided by alerting the user if his or her pulse rate reaches too high or low a level.

The microprocessor 14 also functions to produce a high level pulse on line 24 to boost the gain on an audio amplifier 26 to provide higher volume emphasis on selected words within the synthesized speech patterns produced by the speech synthesizer 18. The synthesized speech pattern is produced on output line 28 which is coupled to the audio amplifier 26. The audio amplifier 26 has a first amplification stage 30 which has an output coupled to a potentiometric volume control 32. A wiper 40 of the potentiometric volume control 32 is coupled to the input of a second amplification stage 42. The gain of the second amplification stage may be varied by the selective coupling of a feedback loop 46 to the input by the closure of a switch 48 upon the application of a high level signal on line 24 to a control terminal 50.

Certain enunciated repetition patterns may be comprised of a sequence of enunciated numbers which are individually separated by a selected motivational word or motivational words such as "squeeze", "exhale", "concentrate", "almost done", "looking good", "toning up", and the like. These phrases are, of course, merely illustrative and other phrases which may be longer or shorter may be deemed preferable depending upon the particular exercise. In the case of walking or running exercises, the phrase "squeeze" would have little or no value, whereas other phrases having particular meaning in the context of running would be more meaningful. Such motivational voice patterns may be enunciated at the frequency of the selected repetition rate. Rather than being inserted between enunciated count numbers in a sequential repetition count, these or other motivational voice patterns may be used to replace one or more count numbers, in which case the repetition numbers which are not verbally enunciated will have to be accounted for by the microprocessor 14 such that when the verbal count is again commenced, it begins with the correct number. Similar means are required in the case of a monitored function other than repetitions. Whether or not such a voice pattern may be inserted between enunciated count numbers in the sequential count or need to be added to replace one or more numbers depends on the length of the particular motivational word or phrase, the selected (and actual) repetition rate, and the enunciation pattern set by the user via the repetition rate selector 12 and enunciation pattern control switch 16. For example, while it may be possible to insert the word "exhale" between consecutively counted repetitions, it may not be possible to insert the phrase "no pain, no gain". As will readily be appreciated by those of ordinary skill in the art, since the time duration between successively enunciated repetitions decreases as the rate of the exercise increases, the microprocessor program will need to determine the amount of time needed for insertion of such motivational words. In the case of monitored exercises functions such as distance, time, speed, pulse rate, and the like, a verbal representation of the monitored function is not usually generated as often as in the case of monitoring exercise repetitions, and it is not ordinarily necessary to generate verbal prompts in place of successive voice counts.

The EEPROM of the microprocessor 14 includes a table of groups of addresses in which the number of groups are equal to the number of combinations of repetition rates, repetition numbers and enunciation patterns which may be selected. Each group of addresses comprises a number of addresses within the dictionary of the speech synthesizer 18 which are equal to the total number of enunciated words and sounds within a set of the selected combination of repetition rate, repetition number and enunciation pattern. One or more additional dummy addresses may be included to complete each table to indicate, for example, that the end of a set has been reached or that either no speech is to be generated for a given count value or that an audible sound other than human speech is to be generated. An example of a table of addresses stored in the microprocessor 14 EEPROM for a set having 50 repetitions in which each individual repetition is to be verbally counted is set forth below in Table I.

TABLE I

TABLE OF ADDRESSES FOR SET HAVING 50 REPETITIONS AND FULL ENUNCIATION

| Enunciated Speech | Relative Table Address |
|---|---|
| One | 1 |
| Two | 2 |
| Three | 3 |
| . | . |
| . | . |

TABLE I-continued

TABLE OF ADDRESSES FOR SET HAVING 50 REPETITIONS AND FULL ENUNCIATION

| Enunciated Speech | Relative Table Address |
|---|---|
| . | . |
| Ten | 10 |
| Eleven | 11 |
| Twelve | 12 |
| Thirteen | 13 |
| . | . |
| . | . |
| . | . |
| Twenty | 20 |
| Twenty One | 20, then 1 |
| Twenty Two | 20, then 2 |
| Twenty Three | 20, then 3 |
| . | . |
| . | . |
| . | . |
| Thirty | 21 |
| Thirty One | 21, then 1 |
| . | . |
| . | . |
| . | . |
| Forty | 22 |
| . | . |
| . | . |
| . | . |
| Fifty | 23 |

As noted above, it may also be desired to emphasize certain words or portions of words. For example, it is often desirable to emphasize the last one or last few count numbers in each set of repetitions when repetitions are being counted. In the case of other monitored exercise functions, the attainment of a target range or other meaningful value may be emphasized. It may also be desired to emphasize some or all alarms and/or motivational words or phrases that may consist of or be inserted in the enunciation pattern. For this purpose, the microprocessor 14 may detect, on the basis of a program, count numbers or words which are to receive audio emphasis. As will be appreciated by those of ordinary skill in the art, this may be accomplished in various manners, all of which are within the scope of the present invention. The encoding of such words may be accomplished by the programming of a logical "one" in an unused bit position within the address bit positions which are available for communicating between the programmed microprocessor 14 and the speech synthesizer 18. For example, the detection of a logical "one" in the unused bit position of an address in the table of addresses may be used in the microprocessor program to signal when to produce one of the series of pulses on line 24 which boosts the gain of the audio amplifier 26. The end of a set within each exercise routine is signalled by the detection of the count number which appears at the end of each set. In Table I, which shows addresses for a set of 50 repetitions, the 23rd address position performs this result. The enunciation of a word within a set of any selected combination of repetition rate, repetition number and enunciation pattern is initiated by the microprocessor control program by sequentially outputting the addresses of each word from the microprocessor 14 on the address bus 20 to the speech synthesizer 18 followed by the outputting of a pulse on line 22 which starts the actual synthesis of the word.

As described above, different address tables are used to access different stored sound data according to various combinations of repetition rate, repetition number and enunciation pattern. While the use of separately stored data accessed by different address tables dependent upon the repetition rate, repetition number and enunciation pattern is one method of achieving a variation in speech patterns, the invention is not so limited. Rather than using different address tables depending upon the repetition rate, the exercise monitor may be designed to count repetitions at a single time base, eliminating selected count values, if necessary, due to timing considerations. Instead, the device may be configured in order to speed up the enunciation of each word within a set by using a repetition rate selector having the potentiometric control and multivibrator as described above. In that case, the speed at which the speech is generated may be increased as the repetition rate is increased for a given combination of repetition number and enunciation pattern. The speed at which the speech is generated can also be varied automatically by the microprocessor based upon detection by the microprocessor of the actual exercise rate.

The simplest form of speech synthesis which is used with the exercise monitor of the present invention has a constant time base for enunciating each particular word independent of the repetition rate. This method is preferable in the case of monitored exercise functions which do not require a frequent voice output, such as pulse rate, distance, speed, and the like. This form of speech synthesis has a disadvantage in the case of monitored functions that necessitate a frequent voice output in that fast repetition rates do not sound natural because the duration of each enunciated word sounds too long for a relatively fast repetition rate. When only one time base duration is used, the upper limit of the rate is reached when the successive words to be enunciated within a set do not have sufficient separation to prevent the words from running together. To produce a voice synthesis which sounds natural for widely varying repetition rates, the use of a multivibrator and potentiometric control for the repetition rate selector permits the use of different time bases for enunciating words which vary with the chosen repetition rate. Instead of one table of addresses for each set, such as that set forth in Table I above, two or more tables of addresses may be used, the first table being assigned to the enunciation of words at the slowest range of exercise rates, and each additional table being used to decrease the enunciation time of the words within the set. The number of tables to be used in the voice synthesis of each set of a given combination of a repetition number and enunciation pattern is purely a matter of choice. For example, when multiple address tables are used, it may be desirable for a given word within a set to be enunciated with half the time base for the highest range of exercise rates rather than the time base used to enunciate the same word at the slowest range of exercise rates.

As will be appreciated by those of ordinary skill in the art, the exercise monitor can be simplified in design by eliminating the ability for the user to define the enunciation rate and by determining the enunciation rate based solely upon a user-defined repetition rate or a repetition rate calculated by the microprocessor based upon the actual exercise repetition rate. As will be further appreciated, the enunciation pattern becomes less problematic when exercise functions other than repetition rate are monitored since a voice count need not generally be provided on such a frequent basis so that the problem of overlapping voice counts is not encountered. Additionally, where a voice count is not generated (or is generated only at selected intervals), or when only motivational phrases are generated, this problem is not encountered.

Figure 2A:
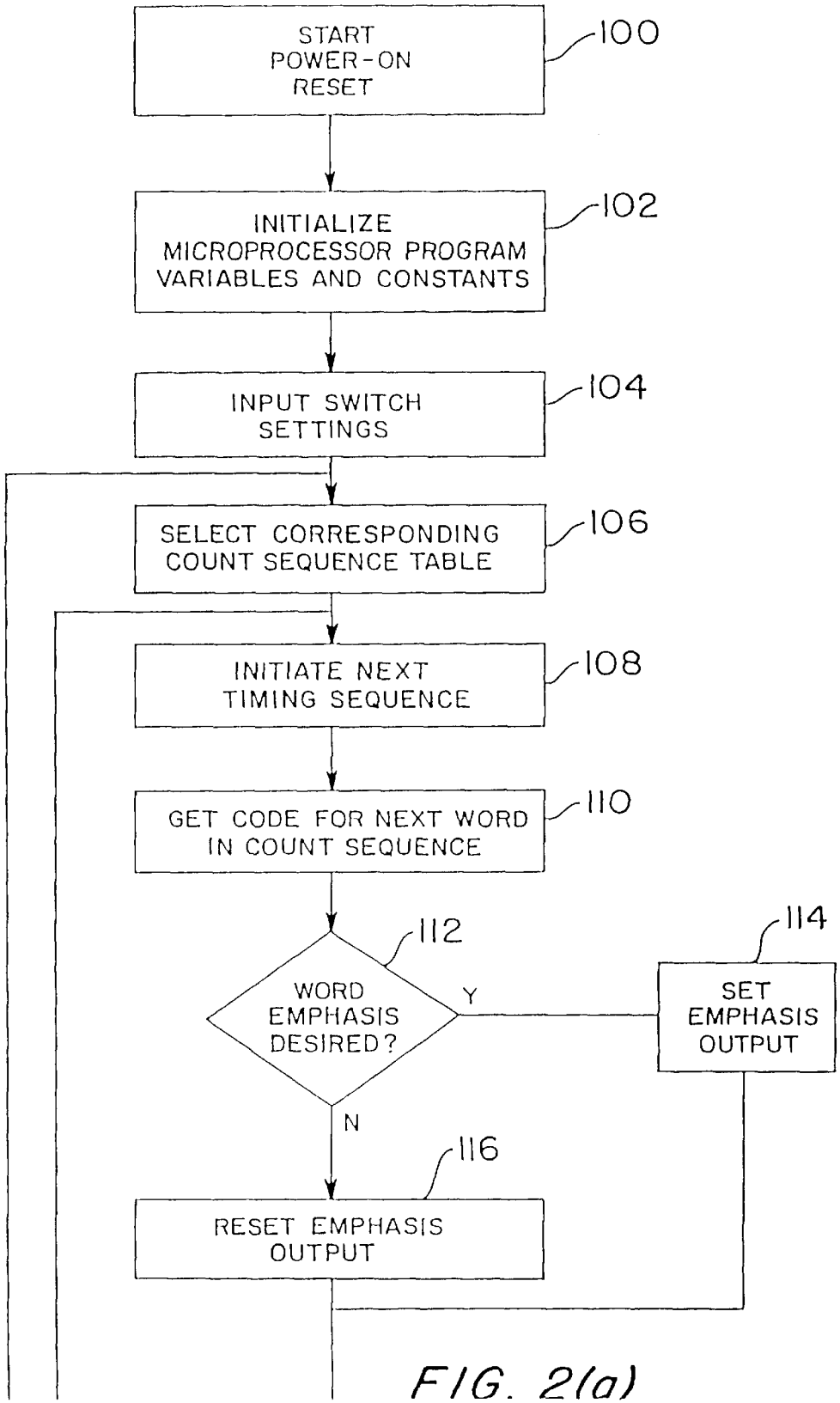
FIGS. 2(*a*) and 2(*b*) are a flowchart illustrating operations performed by the processor illustrated in the embodiment shown in FIG. 1.
Figure 2B:
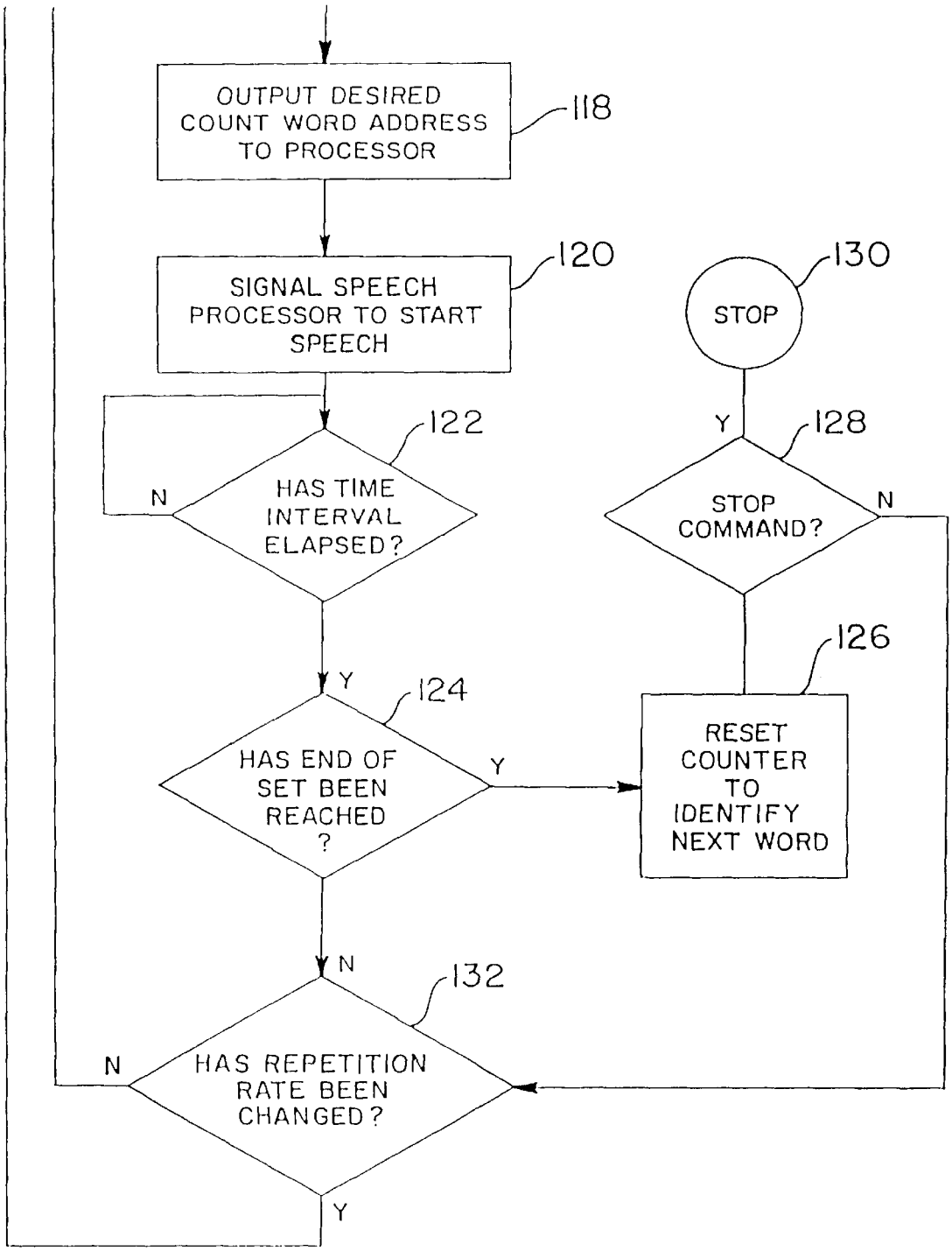

FIG. 2 illustrates a flowchart of a computer program used by the microprocessor 14 for controlling the voice synthesis of any one of a plurality of combinations of repetition numbers and enunciation patterns at a selected exercise repetition rate. The program starts at point 100 where the power is turned on and all circuits are reset. The program next proceeds to step 102 where the microprocessor, input/output lines, program variables and constants are initialized. The program next proceeds to step 104 where the selected combination of repetition number and enunciation pattern is read from the repetition number control switch 15 and enunciation pattern control switch 16 which have been positioned by the user. The preferred choices of repetition number and enunciation pattern have been described above, but it should be clearly understood that the invention is applicable to any desired group of repetition number and enunciation patterns at any selected exercise repetition rate. The program next proceeds to step 106 where the selected combination of repetition number and enunciation pattern is used to identify the group of addresses within the EEPROM of the microprocessor 14 which are to be used to synthesize the voice pattern of an exercise set, based upon the selected repetition rate and in accordance with the selected combination of the repetition number and enunciation pattern.

The table of addresses discussed above would be used in the case where 50 repetitions per set is selected and a verbal count for each repetition is to be enunciated. It should be clearly understood that a group of addresses for each combination of repetition number and enunciation pattern is read from the EEPROM of the microprocessor 14 for synthesizing that particular combination of repetition number and enunciation pattern. Moreover, when the time base is dependent upon the exercise rate, each selected combination of repetition number and enunciation pattern will have as many tables associated with it as there are time bases.

The program next proceeds to step 108 where the monostable multivibrator within the exercise rate selector 12 is triggered and the time interval during which the monostable multivibrator is in its high state is begun. When a repetition signal is detected due to closure of the mechanical switch 22, the program then proceeds to step 110 where the number of the word within a set which is next to be synthesized is obtained by reading the count of an internal counter within the microprocessor 14. In the case of each combination of exercise rate, repetition number and enunciation pattern, the first word is assigned the count of one and each successive word within a set is assigned a successive number until the set is completed. The count functions as the mechanism for choosing the address within the group of addresses used for synthesizing the next word within a set of the selected combination of repetition rate, repetition number and enunciation pattern to be synthesized by the voice synthesizer 18. The program next proceeds to decision point 112 where a determination is made if the audio gain of the audio amplifier 26 is to be increased for the enunciation of that word by closing the switch 48. As described above, the determination is made by checking an unused address bit to determine if it has been set high. If the next word to be synthesized is not to be emphasized, the program proceeds to block 116 where the switch 48 is reset to insure that the audio gain of the audio amplifier 26 will not emphasize the next word. The program then proceeds to step 118 where the address of the next word to be voice synthesized, which has been obtained from the address table, is output on the bus 20 of the microprocessor 14 to the voice synthesizer 18. The program then proceeds to step 120 where an output signal is placed on line 20 of the microprocessor for the purpose of instructing the speech synthesizer 18 to start the voice synthesis of the desired word.

Subsequently, the program proceeds to decision point 122 where the program loops until one word at the chosen rate is completed. The completion of one word is signalled by the repetition rate selector 12 changing from its high state to a low state. As described above, the duration of the high state of the monostable multivibrator within the repetition rate selector 12 is a function of the RC time constant which is determined by the adjustment of the repetition rate selector 12. The program next proceeds to decision point 124 where a determination is made as to whether the end of a set has been reached. In the case of the repetition number illustrated in Table I above, the 23rd address position within the table signals that the end of a set has been reached. If the answer is yes, the program proceeds to step 126 where the internal counter, which is read at step 110 to obtain the address of the next word to be voice synthesized within the group of addresses for the selected combination of repetition rate, repetition number and enunciation pattern is set to 1 to prepare the voice synthesizer 18 to repeat the enunciation of the set. The program proceeds to decision point 128 where a determination is made as to whether a stop command has been issued.

A stop command may be signalled by turning off the power or the pushing of a stop command control (not shown) which may be provided on the front panel of the housing which contains the exercise monitor. If a stop command has been generated, the program enters a stop phase at step 130. If the answer is no, the program proceeds to decision point 132 where a determination is made as to whether the same repetition rate, repetition number and enunciation pattern are still being specified by the repetition rate selector 12, repetition number control switch 15 and enunciation pattern control switch 16. If there is no change in the repetition rate, repetition number and enunciation pattern, the program loops back to step 108 where a new time interval is begun by the exercise rate selection control 112. If there has been a change in the repetition number and enunciation control 16, the program loops to step 106 to obtain the table of a newly selected repetition rate, repetition number and enunciation pattern. If the end of a set has not been detected at decision point 124, the program proceeds to decision point 132 which functions in the manner described above. The program will continue to produce synthesized speech at the selected exercise rate until manually stopped by turning off the power or pushing a stop button. Any adjustment in the selected exercise rate is immediately picked up at block 108 where the time interval is changed by the adjustment of the repetition rate selector 12.

It should be clearly understood that the combination of repetition rate, repetition number and enunciation pattern which have been specifically set forth above is only representative of the potential combinations of repetition rates, repetition numbers and enunciation patterns which may be voice synthesized by the invention. Countless other values and combinations may be used. The invention may also be used for maintaining a desired exercise rate in exercise classes.

The invention has been described in terms of its preferred embodiment. However, it should be clearly understood that numerous modifications may be made thereto without departing from the scope of the invention as defined by the appended claims.

Figure 3:
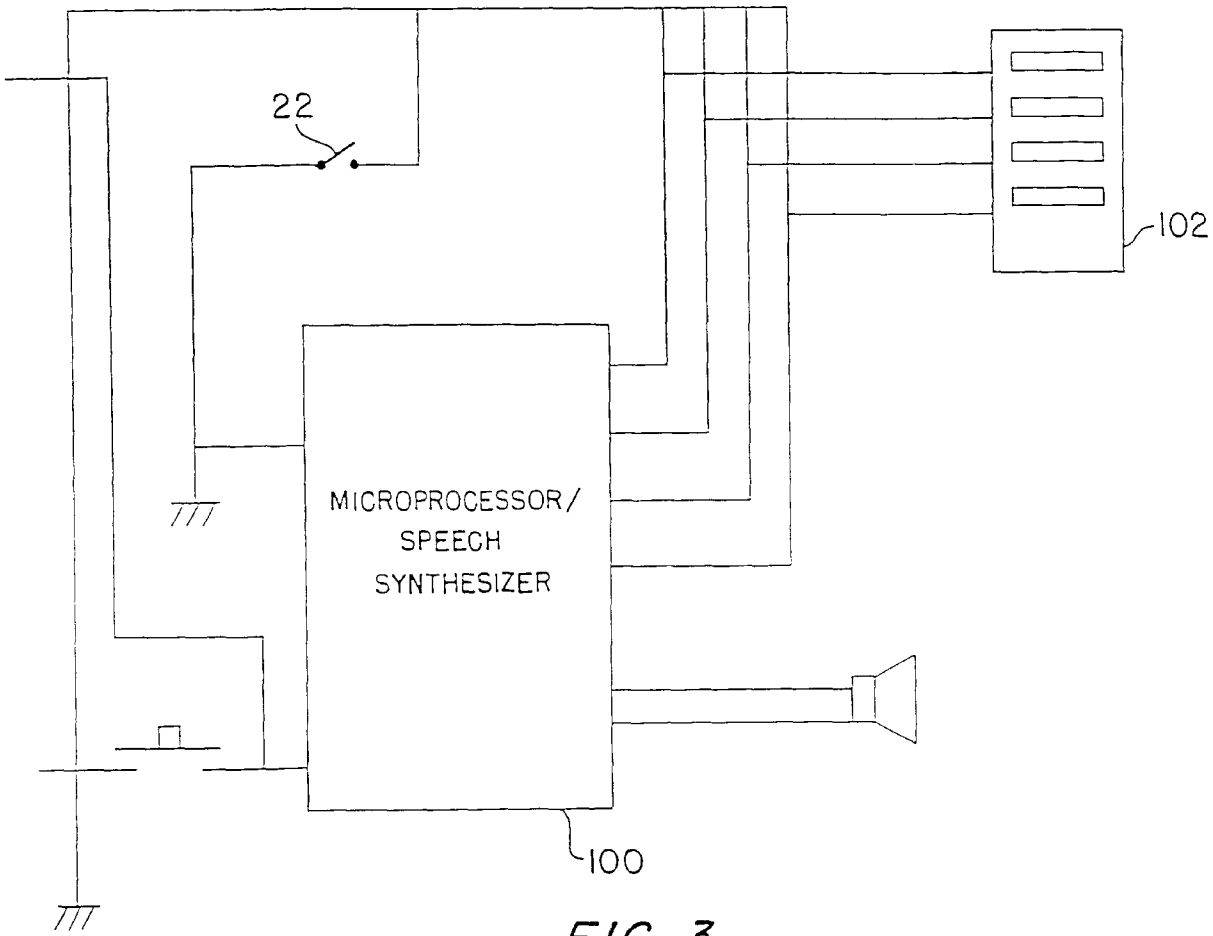
FIG. 3 is a schematic diagram of an exercise monitoring apparatus in accordance with a second embodiment of the present invention.

FIG. 3 illustrates a second embodiment of the electronic exercise monitor of the present invention. In this embodiment, the microprocessor and speech synthesizer, which are shown separately in FIG. 1, are combined in a single microcontroller/speech synthesizer chip 100. While the device is provided with a repetition number control DIP switch 102, no selectors are provided for the setting of a repetition rate or enunciation pattern. These values are instead determined by a microprocessor control program stored in the single chip microcontroller/speech synthesizer 100. In addition, amplification of the synthesized speech or audible indicia is performed internally, and is also set by the microprocessor program in a known manner.

More detailed embodiments are shown in the schematic diagrams of FIGS. 4–9. In each of the embodiments illustrated in FIGS. 4–9, a single chip microcontroller/speech generator 100 produced by Texas Instruments (model 50C11) is used. This device permits the simple storage of speech and is programmable by means well known to those of ordinary skill in the art to provide the functions described herein. In FIGS. 4–9, elements having the same structure are denoted by the same reference numeral.

Figure 4:
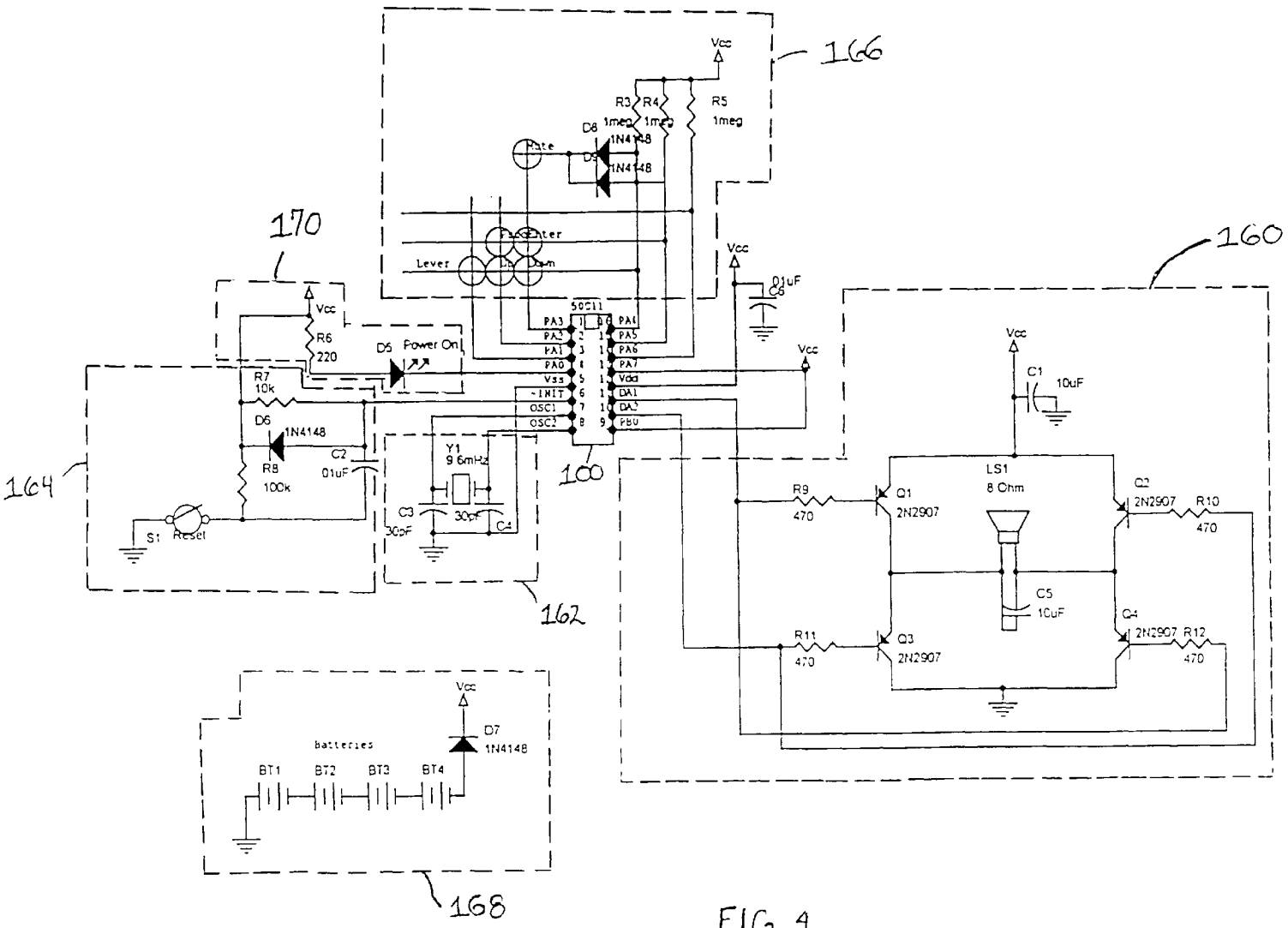
FIG. 4 is a schematic diagram of an exercise monitoring apparatus in accordance with a third embodiment of the present invention.

FIG. 4 is a detailed schematic diagram of an electronic exercise monitor and repetition counter having a structure similar to that shown in block diagram form in FIG. 3. Circuit block 160 is an audio amplifier circuit and audio speaker for producing synthesized speech corresponding to a repetition count and motivational phrases. Circuit block 162 is an oscillator circuit for driving the microcontroller/speech synthesizer 100. Circuit block 164 is a reset switch circuit which initializes the microcontroller/speech synthesizer 100. Circuit block 166 is a switch circuit for controlling the exercise monitor. Resistors R3, R4 and R5 are pullup resistors which apply a positive voltage to the microcontroller/speech synthesizer 100. Pressing a respective switch "pulls" the voltage applied to a respective input terminal of the microcontroller/speech synthesizer 100 to +5V. The microcontroller/speech synthesizer 100 detects this and responds accordingly based upon the microprocessor control program stored in the microcontroller/speech synthesizer 100.

As illustrated in circuit block 166 of FIG. 4, the device is provided with a plurality of input "keys", including a "program" key, an "enter" key, a "lever" key, an "up" key, a "down" key and a "mute" key. With the exception of "lever", these keys comprise pushbuttons on the external housing of the device. The "lever" key denotes a mechanical switch similar to the switch discussed in connection with the first embodiment of FIG. 1. As described above, the mechanical switch undergoes a temporary closure for each successive exercise repetition, which is detected by the microcontroller/speech synthesizer 100 to monitor the user's successive exercise repetitions.

The microcontroller/speech synthesizer 100 is programmed by known means to respond to the "program" key by entering a program mode. In the program mode, the number of repetitions (repetition number) can be changed from a default value by operation of the "up" and "down" keys and subsequent pressing of the "enter" key to select a desired value. Thus, for instance, a default value associated with repetition number can be pre-stored in the microcontroller/speech generator. By depressing the "program" key, followed by the "up" or "down" key, the default repetition number can be changed. Preferably, the microcontroller/speech synthesizer 100 issues a verbal representation of the default value when the "program" key is pressed, and issues a verbal representation each time the repetition number is changed by pressing the "up" or "down" key.

The microcontroller/speech synthesizer 100 is programmed to respond to the "lever" key to increment the repetition count and to issue a verbal representation of the repetition count for selected values which are pre-programmed in the microcontroller/speech synthesizer. As described above, by issuing a verbal representation of a repetition count at selected time intervals, the problem of one count number overlapping a subsequent count number is avoided.

In addition, a "mute" key is provided to toggle on/off the verbal output. The microcontroller/speech synthesizer 100 is programmed to respond to the "mute" key to deactivate the verbal output of repetition numbers or motivational phrases. Thus, for example, the device can be operated so as to provide either a verbal count of selected repetitions by itself, or a count plus motivational phrases which are issued depending upon the monitored count value, or both a verbal count and motivational phrases.

Circuit block 166 comprises four series-connected batteries for providing power to the unit. Circuit block 170 is a circuit for illuminating a light emitting diode when the power is turned on via reset switch S1. In order to light the diode, the microcontroller/speech generator 100 pulls its connected pin to zero volts. Current flows from Vcc through resistor R6 and diode D5, causing it to emit light.

As will be appreciated by those of ordinary skill in the art, the device illustrated in FIG. 4 is somewhat simplified in design as compared to that illustrated in FIGS. 1, 2(*a*) and 2(*b*) since there are no separate means for entering an enunciation pattern and a repetition rate. Accordingly, the device is programmed to issue a verbal output having a single time base and to generate a voice count for only selected repetitions. There is thus no need in this embodiment for providing separate address tables and separate sets of data for each time base. In an alternative embodiment, additional keys can be added and the microprocessor control program can be modified to respond to those keys to provide variable selection means for the enunciation pattern and repetition rate. In such case, a series of LEDs or an audible output can be added to the device to simulate a desired pace based upon the selected repetition rate.

Figure 5:
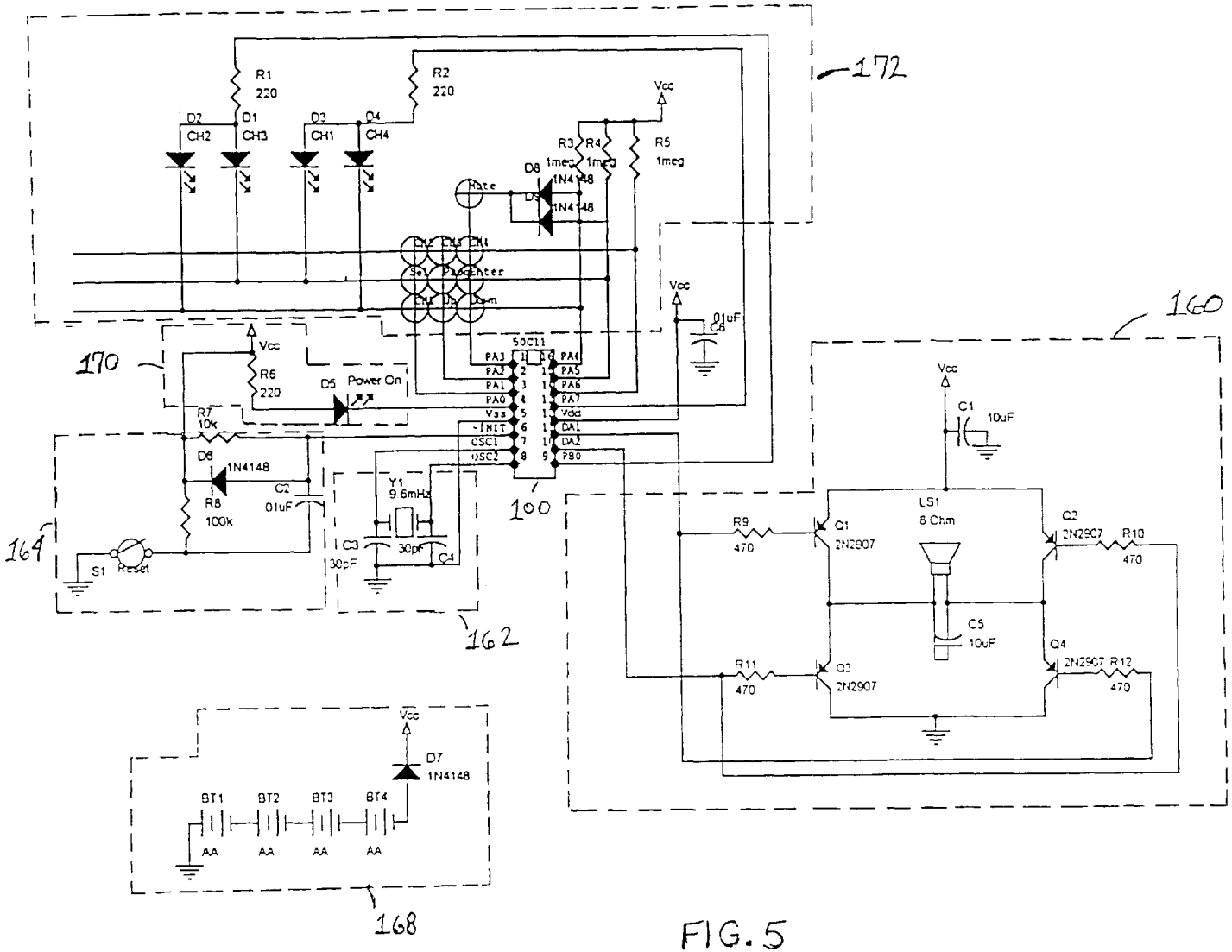
FIG. 5 is a schematic diagram of an exercise monitoring apparatus in accordance with a fourth embodiment of the present invention.

FIG. 5 is a schematic diagram of an exercise monitor similar to that shown in FIG. 4. In this embodiment, however, the "lever" key is replaced by four independent input channels CH1–CH4 so that four different functions can be monitored by the use of a mechanical switch of the type described above. Circuit block 172 denotes a switch circuit having key inputs for selecting each of channels CH1–CH4, along with the "program", "enter", "up" and "down" keys described above. Light emitting diodes D1–D4 are provided to indicate a selected channel. In this embodiment, four different exercise detectors may be connected to the device through each of channels CH1–CH4. A channel is selected by depressing one of the channel keys CH1–CH4. The microcontroller/speech synthesizer 100 is programmed to monitor the selected channel and to provide verbal output in the manner described above. Thus, when a respective channel is selected and a mechanical switch is connected thereto, the device can function as a repetition counter as described above.

As will be readily appreciated, the microprocessor control program can be modified to recognize various types of inputs. Thus, channels CH1–CH4 need not be limited to receiving inputs from a mechanical switch. Other types of exercise detectors may be used to monitor other types of functions. Thus, a conventional pulse monitor output can be used as one input channel, while other input channels can be connected to detectors for monitoring distance, speed, and the like, by modifying the microprocessor control program to detect the outputs of such conventional detectors and to calculate a corresponding value (e.g., pulse rate, calories expended, distance, speed, and the like) using conventional programming techniques well known to those of ordinary skill in the art.

Figure 6:
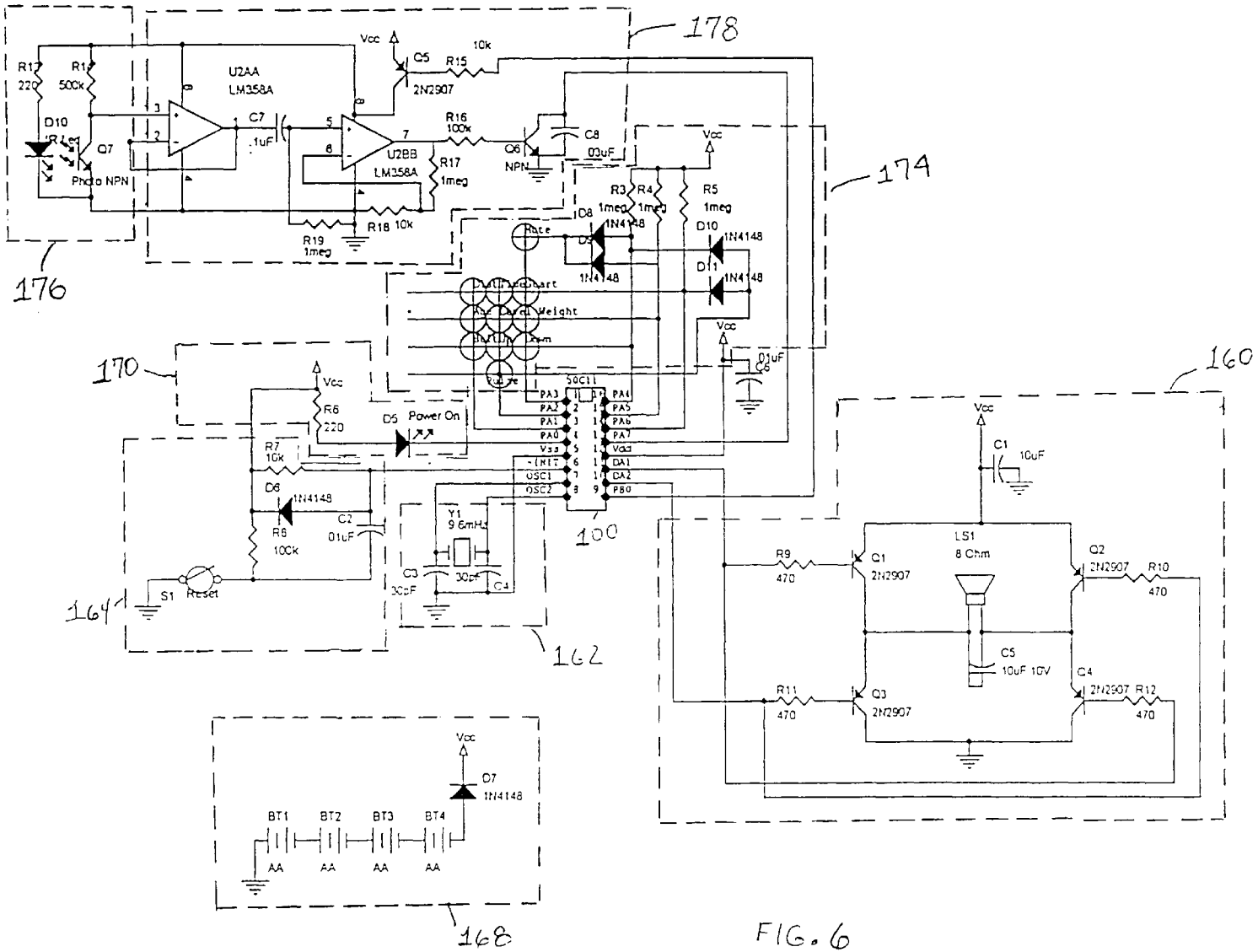
FIG. 6 is a schematic diagram of an exercise monitoring apparatus in accordance with a fifth embodiment of the present invention.

FIG. 6 is a schematic diagram of an embodiment connectable to a treadmill or exercise bicycle for monitoring the distance travelled, the user's pulse rate and calories expended. As is well known to those of ordinary skill in the art, distance is easily calculated based upon an input signal output from a conventional detection means connectable to stationary bicycle or treadmill. Calories expended during an exercise routine may also be easily calculated using well known equations relying upon pulse and demographic data (such as age and weight).

Circuit block 174 is a switch circuit having input keys including "distance", "time", "start", "age", "level", "weight", "belt", "up", "down", "pulse" and "mute". The "mute", "up" and "down" keys function in the manner described above. To operate the device, the user selects a distance he or she wishes to walk (or run) on a treadmill or pedal on a stationary bicycle by operating the "distance" key. The "up" and "down" keys are used to vary the distance from a default value in the manner described above. Thus, for instance, when the "distance" key is operated, the microprocessor control program causes the device to produce a verbal representation of a default distance value, which is varied by use of the "up" and "down" keys, with each deviation resulting in a verbal representation. Similarly, a desired exercise "time" can be selected by operating the "time" key along with the "up" and "down" keys. The user enters his or her age and weight using the "age" and "weight" keys. The "belt" key is an input attached to a conventional wheel encoder which engages the belt of a treadmill and outputs a signal indicating movement of the belt. This signal is detected by the microcontroller/speech synthesizer 100 and the distance travelled is determined therefrom. The user presses the "start" key to start the monitoring process.

Circuit block 176 is a pulse monitor comprising a combination of a photoemitter D10 and a photodetector Q7 for detecting the user's pulse. Circuit block 178 is an operational amplifier circuit that amplifies the signal output by the photodetector Q7 using a unity gain buffer and a voltage amplifier with a gain of 100. The original input voltage controls discharge time of the capacitor C8. The output of the capacitor C8 is input to the microcontroller/speech generator 100 and the microprocessor control program measures the discharge time of the capacitor C8 and, based upon this time, calculates the user's pulse. As will be appreciated by those of ordinary skill in the art, there are many different methods used to calculate pulse and any known method is considered within the scope of the invention.

Figure 7:
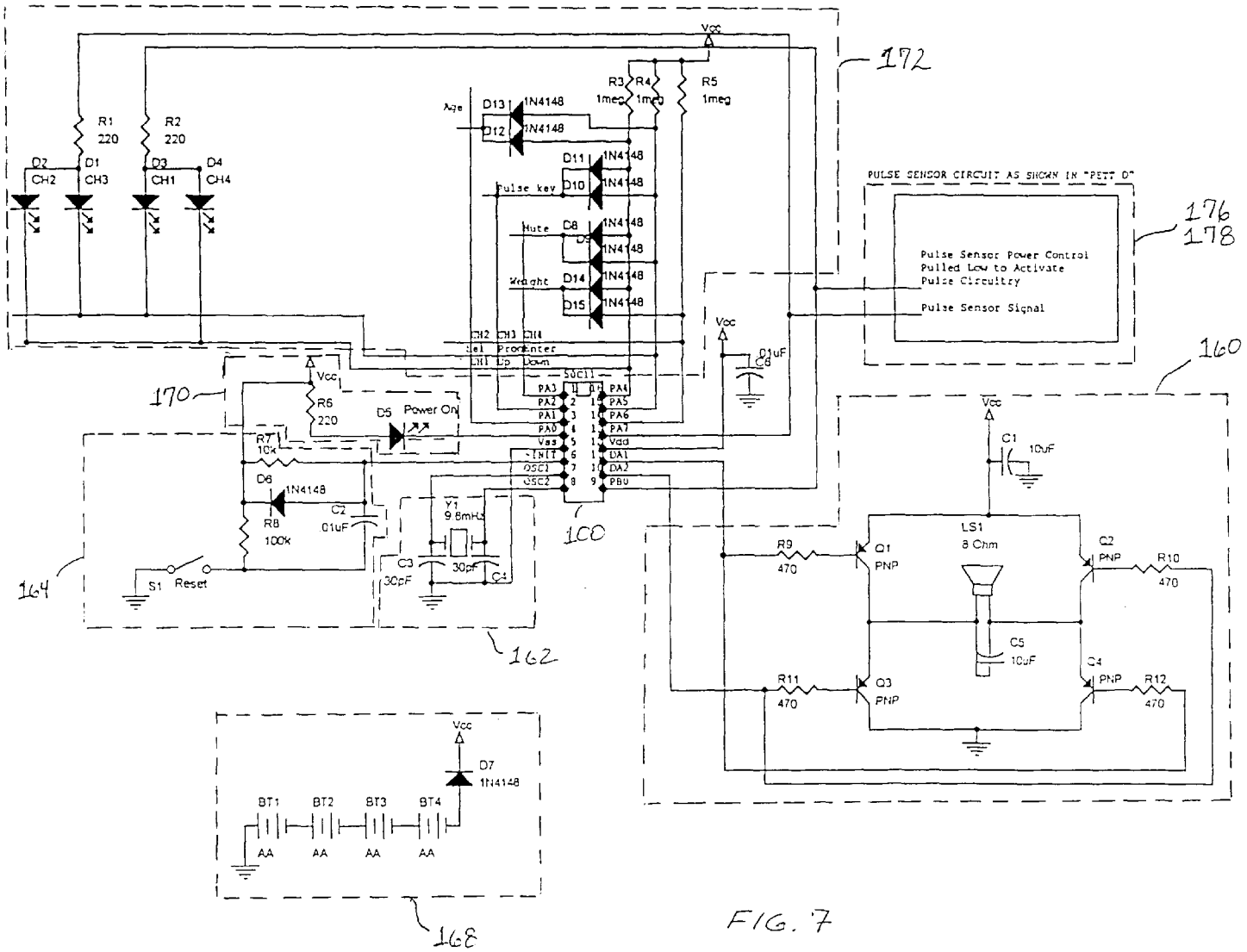
FIG. 7 is a schematic diagram of an exercise monitoring apparatus in accordance with a sixth embodiment of the present invention.

FIG. 7 is a schematic diagram of an embodiment having four channels CH1–CH4, as in the FIG. 5 embodiment, and also provided with an electronic pulse monitor and calorie counter. The microcontroller/speech generator 100 is programmed to count calories expended during an exercise depending upon the user's age and weight. A determination of calories expended may also be based upon exercise factors relevant to the monitored exercise.

Figure 8:
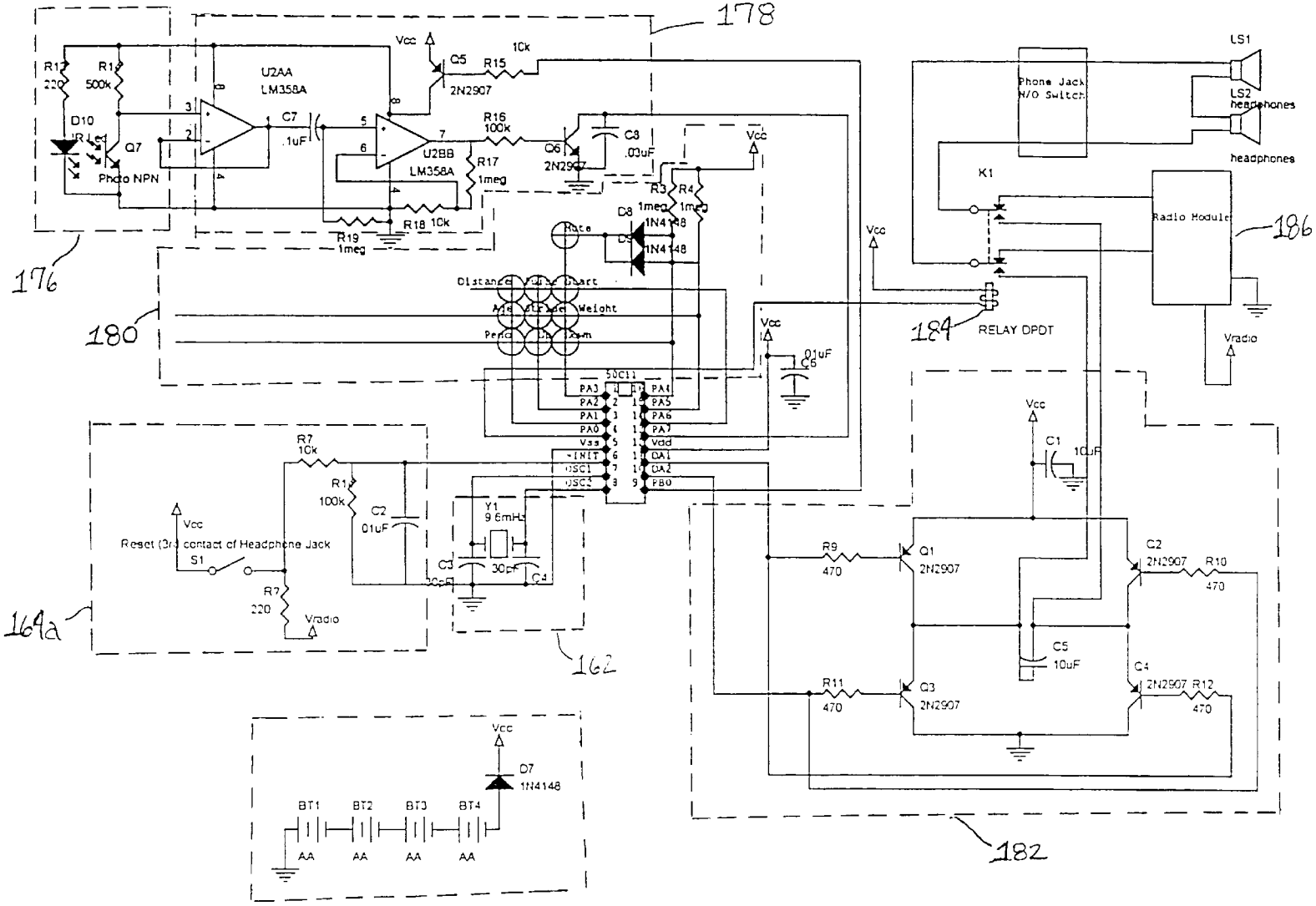
FIG. 8 is a schematic diagram of an exercise monitoring apparatus in accordance with a seventh embodiment of the present invention.

FIG. 8 is a schematic diagram of an embodiment in which the electronic exercise monitor functions as a pedometer. An output of a conventional pedometer device is connected to the "pedo" key of circuit block 180. The microprocessor control program detects this signal and calculates a distance based upon the value of the user's "stride" as selected by the user. This embodiment also includes a pulse sensor and optional calorie as described above. Circuit block 182 is an audio amplifier circuit which differs from circuit block 160 of FIGS. 4–7 in that headphones having a pair of speakers LS1 and LS2 replace the single speaker of the previous embodiments. In addition, a relay 184 controlled by the microcontroller/speech synthesizer 100 is used to switch between the audio output of the exercise monitor and a radio module 186 under control of the microprocessor control program. Thus, for example, at pre-stored time intervals when it is determined that a verbal output is to be generated, the microcontroller/speech generator 100 issues an output signal on line PA0 to cause the relay 184 to switch the headphones from an audio output of the radio module 186 to the audio output of the exercise monitor so that the user can hear the verbal message generated by the exercise monitor, e.g., distance walked, pulse rate, calories expended, and the like, any of which can be generated at desired intervals in the manner described above. In addition, the reset switch S1 is configured to be operated by the jack of the headphones, such that the device is turned on when the headphone jack is inserted therein.

As noted above, the exercise monitor of the present invention may be used as a stand-alone device for monitoring any type of repetitive exercise activity, or may be incorporated into a piece of exercise equipment of the type having a displaceable member adapted to undergo reciprocal or repetitive movement during an exercise routine. In the former case, for instance, the mechanical switch 22 (exercise motion detector) must be placed in a position in which closure of the switch will occur once for each repetition. For example, when the exercise is situps, the switch may be of appropriate design such that when placed on the floor or on an exercise mat (or mounted within the mat), the switch contacts become temporarily closed once for each situp. The mechanical switch 22 may also be disposed on or in an exercise device such that the contacts become temporarily closed in a similar manner. For instance, if the mechanical switch 22 is disposed in a free weight or bar, the switch must be of an appropriate design so as to undergo temporary closure once each repetition. Of course, the exercise motion detector 22 need not be a mechanical switch, and may constitute any device capable of detecting a desired activity, such as those described above or others within the knowledge of those of ordinary skill in the art.

Figure 9A:
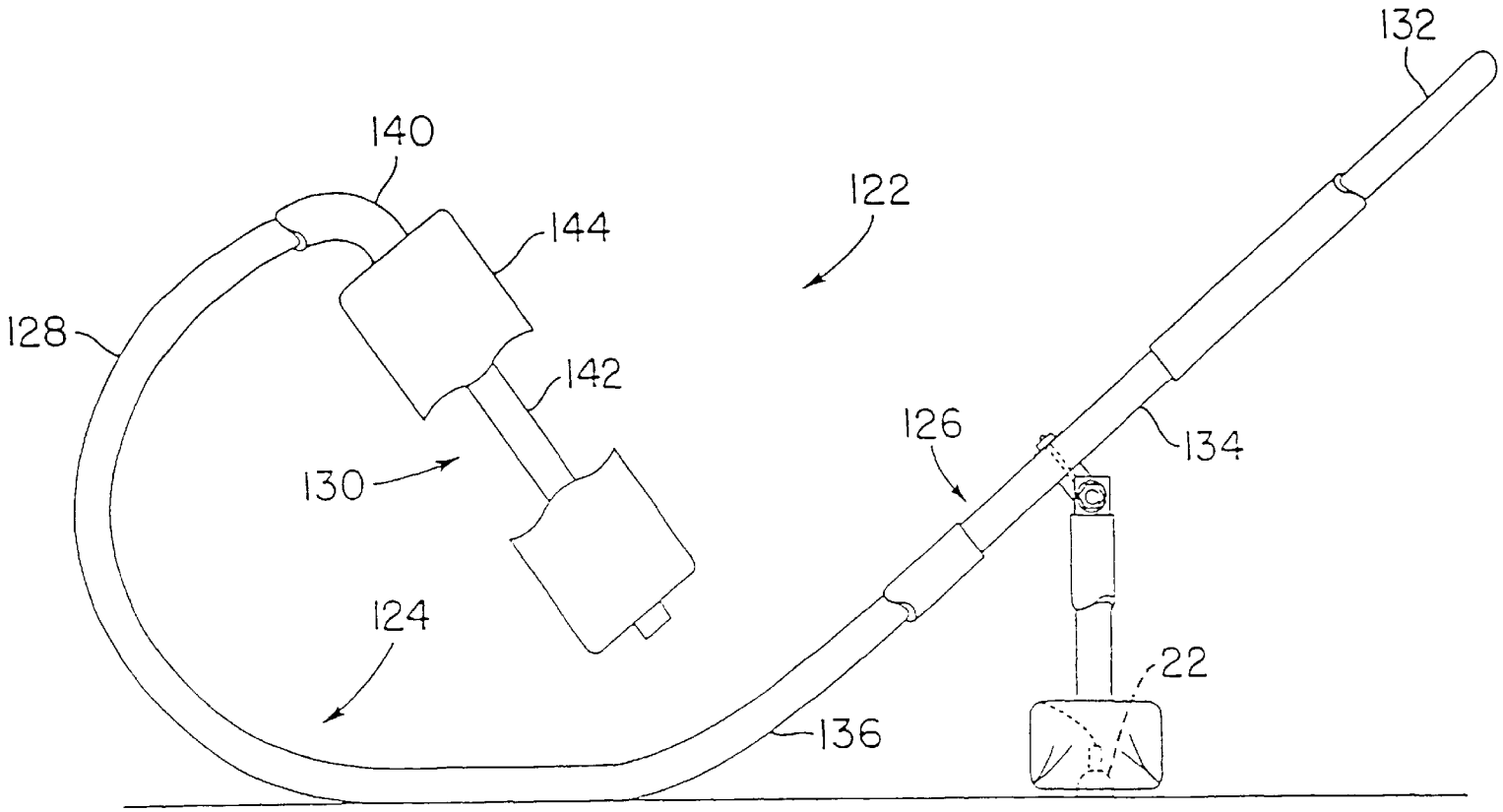
FIGS. 9(*a*) and 9(*b*) are diagrams of an abdominal exercise device to which the exercise monitoring apparatus of the first and second embodiments may be mounted.
Figure 9B:
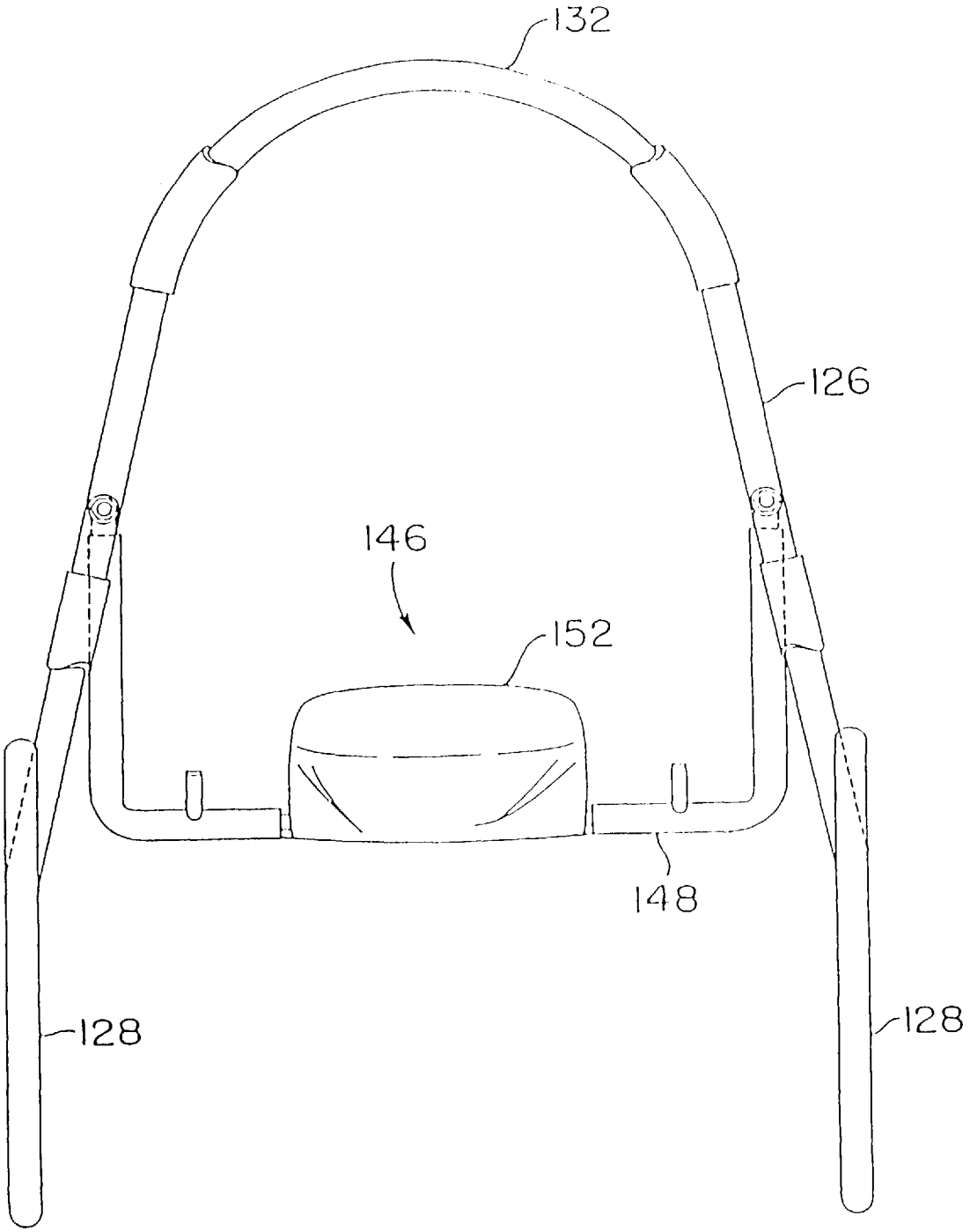

An embodiment of an electronic repetition counter according to the present invention is illustrated in FIGS. 9(*a*) and 9(*b*), which illustrate the exercise monitor 120 of the present invention as mounted to an abdominal exerciser 122. The abdominal exerciser 122 is formed of a skeletal frame 124, for example, from a single hollow tube of aluminum or other rigid material. The skeletal frame 124 includes a pair of support rails 126, a pair of arcuate rocker portions 128, each of which extends forwardly from a respective support rail 126, a pair of arm rest portions 130, each of which extends from a respective rocker portion 128, and an arch-shaped portion 132 which is connected to and between the support rails 126.

The support rails 126 are laterally spaced from each other to rest on a support surface, such as a floor. Each support rail 126 extends between a rocker portion 128 and the arch-shaped portion 132 and, as illustrated, each support rail 126 includes a straight portion 134 which extends from a rocker portion 128, and an arcuate portion 136 extending from the straight portion 134 .

The two rocker portions 128 are parallel to each other but may also be directed inwardly towards each other at a small angle to accommodate the elbows of the person using the abdominal exerciser device 122. Each arm rest portion 130 extends from a rocker portion 128 and is bent over to form an L-shape. As illustrated, each arm rest portion 130 has a curved portion 140 extending from a rocker portion 128 and a straight free end portion 142. The curved portion 140 forms a right angle bend. In addition, the free end portion 142 has a removable cushion 144 mounted thereon to receive an elbow or arm of the person disposed between the support rails 126.

As shown, a support means 146 is secured to and across the arch-shaped portion 132 for supporting the neck and head of a person disposed between the support rails 126. The support means 146 includes a rigid U-shaped bar 148, for example, of aluminum which is pivotally mounted by suitable means 150 on the straight portions of the arch-shaped portion. In addition, the support means 146 includes a padded head rest 152 which is secured to a horizontal part of the U-shaped bar. The U-shaped bar 148 is freely pivotable relative to the arch-shaped portion so as to be moved from a position as shown in the drawings in which the bar is vertical and rests on a floor or on other support surface.

When the exercise device 122 is in a position of rest, the user may perform an exercise which involves resting one's head on the head rest while grasping the arch-shaped portion and resting one's arms and elbows on the arm rest cushions. At this time, the user may raise his/her legs into a vertical position. The legs may then be lowered while being maintained in a parallel relation.

In order to conduct an exercise program for exercising the abdominal muscles, the following steps are followed:

First, the user positions himself or herself in a supine position within the skeletal frame of the exercise device while placing his or her neck and head on the head rest of the support means.

Next, the user rests his or her elbows on the arm rest portions, that is, on the cushions slidably mounted on the arm rest portions. The user is now ready to begin a curling exercise. At this time, with the user's hands gripping the upstanding arch-shaped portion, the user begins to curl his or her spine forwardly while rocking the frame forwardly on the rocker portions. After reaching a partially flexed or fully flexed position, the user returns to the supine position while rocking the skeletal frame rearwardly on the rocker portions. The curling and uncurling steps are repeated until the exercise program has been completed.

The mechanical switch 22 of the exercise monitor 120 comes into contact with the floor each time the user completes a single repetition. The switch 22 provides a pulse output signal each time a repetition is performed. The pulse is provided as an input to the microprocessor 14 shown in FIG. 1, or as an input to the combined microprocessor/speech synthesizer device 100 illustrated in FIG. 3. Accordingly, when exercise is performed using the abdominal exerciser, the exercise monitor 120 generates a human voice to count the repetitions being performed by the user in accordance with the repetition rate, repetition number and enunciation pattern set by the user. Motivational words are preferably interlaced within the verbal count by the microprocessor program to provide the user with encouragement and motivation which has not heretofore been available.

In a like manner, the exercise monitor may be incorporated into many different types of exercise equipment, such as a barbell, dumbbell, rowing machine, or universal-type equipment such as a chest press machine, a rigid arm lat pull-down machine, a shoulder press machine, a pectoral fly machine, a seated hamstring machine, a leg extension machine, an inner/outer thigh combo machine, or an abdominal crunch machine. As will be appreciated by those of ordinary skill in the art, depending upon the exercise for which the monitor is used or the type of equipment in which it is incorporated, the motivational speech patterns will be different, in each case being relevant to the exercise being performed.

Figure 10:
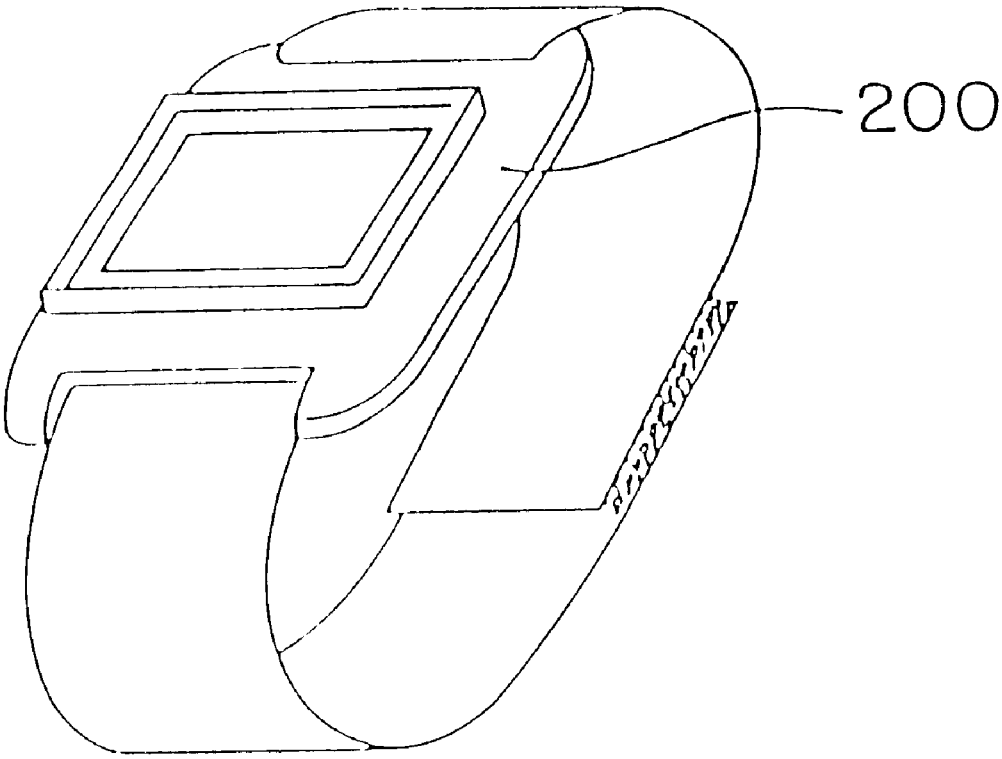
FIG. 10 is an external view of a watch case worn on a user's wrist, in which an exercise monitor of the present invention may be incorporated and including a pulse detector worn on the user's finger.

FIG. 10 is an illustration of the exercise monitor of the present invention as incorporated into a watch case 200. As noted above, the exercise motion detector need not be a mechanical switch, but can be a device capable of detecting repetitious motion in a given direction, such as an accelerometer, GPS (global positioning satellite) detector, or the like. Thus, by providing the exercise monitor in a watch case, the device is capable of detecting exercises that involve arm movement, such as walking or running, situps, and the like. Similarly, the device can be provided in a case capable of being worn on a user's waist, neck, ankle, and the like.

Additionally, the device may be programmed to issue not only motivational speech patterns, but also promotional speech patterns to promote one or more commercial products of a given producer or supplier. In that case, such speech patterns are preferably generated as the individual commences or completes a particular set of exercises.

As noted above, one of the functions that may be monitored by the exercise monitor of the present invention is the user's breathing pattern. Thus, for instance, while the user is performing a particular exercise the device can monitor the user's breathing pattern by monitoring the expansion and contraction of the user's chest. Alternatively, the device can monitor the air flow from the user's nose and/or mouth to determine the user's breathing pattern. The device can be programmed in the above-described manner to assist the user in controlling his or her breathing pattern based upon information a such as repetition rate and the like. By comparing the user's breathing pattern with pre-stored or calculated information indicating the correct breathing pattern, the device can issue verbal alarms or instructions to assist the user.

The invention has been described in terms of various preferred embodiments and variations thereof. However, it should be clearly understood that numerous modifications may be made thereto without departing from the scope of the invention as defined by the appended claims.

I claim:

1. An exercise monitor for monitoring the repetitive performance of an exercise, comprising: a switch mountable during use of the exercise monitor to a reciprocally displaceable member of an exercise equipment, the switch being responsive to the reciprocal motion of the displaceable member to output a signal for each of a plurality of sequential exercise repetitions performed by the user on the exercise equipment; processing means for receiving the signals and determining for each a starting address at which a block of corresponding sound data is stored; a memory for storing sound data for each of the plurality of sequential exercise repetitions, the sound data including data representing a voice count number for each repetition of an exercise; and a speech generator for generating a voice in accordance with the sound data stored in the memory, the speech generator being controlled by the processing means in response to the switch to progressively count sequential exercise repetitions performed by the user.

2. An exercise monitor according to claim 1; wherein the switch has a contact member disposed such that each full cycle of motion of the displaceable member causes a single, temporary closure of the switch contacts so as to permit the generation of a pulse signal and to permit detection of successive exercise repetitions which are to be verbally counted by the exercise monitor.

3. An exercise monitor according to claim 1; wherein the speech generator includes means for generating a voice count for selected ones of the exercise repetitions.

4. An exercise monitor according to claim 1; further comprising display means for providing a visual display of the number of exercise repetitions being performed.

5. An exercise monitor according to claim 1; further comprising a selector for selecting an exercise rate at which voice patterns will be produced, the selected rate being variable between a predetermined minimum value and a predetermined maximum value.

6. An exercise monitor according to claim 1; further comprising a selector for selecting a desired number of repetitions per set.

7. An exercise monitor according to claim 1; further comprising a selector for selecting an enunciation pattern at which the voice will be produced.

8. An exercise monitor according to claim 1; further comprising means for issuing verbal encouragement to motivate the user to continue to perform the exercise correctly; wherein the processing means includes means for issuing the verbal encouragement between or in the place of one or more successive verbal count numbers depending upon the length of the verbal encouragement words, the repetition rate and the enunciation pattern.

* * * * *